US006199037B1

(12) United States Patent
Hardwick

(10) Patent No.: US 6,199,037 B1
(45) Date of Patent: Mar. 6, 2001

(54) JOINT QUANTIZATION OF SPEECH SUBFRAME VOICING METRICS AND FUNDAMENTAL FREQUENCIES

(75) Inventor: John C. Hardwick, Sudbury, MA (US)

(73) Assignee: Digital Voice Systems, Inc., Burlington, MA (US)

( * ) Notice: Subject to any disclaimer, the term of this patent is extended or adjusted under 35 U.S.C. 154(b) by 0 days.

(21) Appl. No.: 08/985,262

(22) Filed: Dec. 4, 1997

(51) Int. Cl.[7] ..... G10L 11/06; G10L 19/02
(52) U.S. Cl. ..... 704/208; 704/222; 704/230
(58) Field of Search ..... 704/207, 208, 704/222, 230

(56) References Cited

U.S. PATENT DOCUMENTS

| | | | |
|---|---|---|---|
| 3,706,929 | 12/1972 | Robinson et al. | 375/216 |
| 3,975,587 | 8/1976 | Dunn et al. | 704/208 |
| 3,982,070 | 9/1976 | Flanagan | 704/265 |
| 4,091,237 | 5/1978 | Wolnowsky et al. | 704/207 |
| 4,422,459 | 12/1983 | Simson | 600/515 |
| 4,583,549 | 4/1986 | Manoli | 600/391 |
| 4,618,982 | 10/1986 | Horvathe t al. | 704/219 |
| 4,622,680 | 11/1986 | Zinser | 375/245 |
| 4,720,861 | 1/1988 | Bertrand | 704/222 |
| 4,797,926 | 1/1989 | Bronson et al. | 704/214 |
| 4,821,119 | 4/1989 | Gharavi | 348/208 |
| 4,879,748 | 11/1989 | Picone et al. | 704/208 |
| 4,885,790 | 12/1989 | McAuley et al. | 704/265 |
| 4,979,110 | 12/1990 | Albrecht et al. | 600/301 |
| 5,023,910 | 6/1991 | Thomson | 704/206 |
| 5,036,515 | 7/1991 | Freeburg | 371/5.5 |
| 5,054,072 | 10/1991 | McAulay et al. | 704/207 |
| 5,067,158 | 11/1991 | Arjmand | 701/219 |
| 5,081,681 | 1/1992 | Hardwick et al. | 704/268 |
| 5,091,944 | 2/1992 | Takahashi | 704/219 |

(List continued on next page.)

FOREIGN PATENT DOCUMENTS

| | | | |
|---|---|---|---|
| 123456 | 10/1984 (EP) | | H04N/7/12 |
| 154381 | 9/1985 (EP) | | G10L/9/14 |
| 0833305 * | 4/1998 (EP) | | G10L/9/14 |
| 92/05539 | 4/1992 (WO) | | G10L/7/02 |
| 92/10830 | 6/1992 (WO) | | G10L/5/00 |

OTHER PUBLICATIONS

Almeida et al., "Harmonic Coding: A Low Bit–Rate, Good–Quality Speech Coding Technique," IEEE (1982), pp. 1664–1667.

Almeida, et al. "Variable–Frequency Synthesis: Am Improved Harmonic Coding Scheme", ICASSP (1984), pp. 27.5.1–27.5.4.

(List continued on next page.)

*Primary Examiner*—Tālivaldis I. Šmits
(74) *Attorney, Agent, or Firm*—Fish & Richardson, P.C.

(57) ABSTRACT

Speech is encoded into a frame of bits. A speech signal is digitized into a sequence of digital speech samples that are then divided into a sequence of subframes. A set of model parameters is estimated for each subframe. The model parameters include a set of voicing metrics that represent voicing information for the subframe. Two or more subframes from the sequence of subframes are designated as corresponding to a frame. The voicing metrics from the subframes within the frame are jointly quantized. The joint quantization includes forming predicted voicing information from the quantized voicing information from the previous frame, computing the residual parameters as the difference between the voicing information and the predicted voicing information, combining the residual parameters from both of the subframes within the frame, and quantizing the combined residual parameters into a set of encoded voicing information bits which are included in the frame of bits. A similar technique is used to encode fundamental frequency information.

30 Claims, 9 Drawing Sheets

U.S. PATENT DOCUMENTS

| | | | | |
|---|---|---|---|---|
| 5,095,392 | | 3/1992 | Shimazaki et al. | 360/40 |
| 5,195,166 | | 3/1993 | Hardwick et al. | 704/200 |
| 5,216,747 | | 6/1993 | Hardwick et al. | 704/208 |
| 5,226,084 | | 7/1993 | Hardwick et al. | 704/219 |
| 5,226,108 | | 7/1993 | Hardwick et al. | 704/200 |
| 5,247,579 | | 9/1993 | Hardwick et al. | 704/230 |
| 5,265,167 | | 11/1993 | Akamine et al. | 704/220 |
| 5,517,511 | | 5/1996 | Hardwick et al. | 371/37.4 |
| 5,778,334 | * | 7/1998 | Ozawa et al. | 704/219 |
| 5,806,038 | * | 9/1998 | Huang et al. | 704/268 |

OTHER PUBLICATIONS

Atungsiri et al., "Error Detection and Control for the Parametric Information in CELP Coders", IEEE (1990), pp. 229–232.

Brandstein et al., "A Real–Time Implementation of the Improved MBE Speech Coder", IEEE (1990), pp. 5–8.

Campbell et al., "The New 4800 bps Voice Coding Standard", Mil Speech Tech Conference (Nov. 1989), pp. 64–70.

Chen et al., "Real–Time Vector APC Speech Coding at 4800 bps with Adaptive Postfiltering", Proc. ICASSP (1987), pp. 2185–2188.

Cox et al., "Subband Speech Coding and Matched Convolutional Channel Coding for Mobile Radio Channels," IEEE Trans. Signal Proc., vol. 39, No. 8 (Aug. 1991), pp. 1717–1731.

Digital Voice Systems, Inc., "INMARSAT–M Voice Codec", Version 1.9 (Nov. 18, 1992), pp. 1–145.

Digital Voice Systems, Inc., "The DVSI IMBE Speech Compression System," advertising brochure (May 12, 1993).

Digital Voice Systems, Inc., "The DVSI IMBE Speech Coder," advertising brochure (May 12, 1993).

Flanagan, J.L., Speech Analysis Synthesis and Perception, Springer–Verlag (1982), pp. 378–386.

Fujimura, "An Approximation to Voice Aperiodicity", IEEE Transactions on Audio and Electroacoutics, vol. AU–16, No. 1 (Mar. 1968), pp. 68–72.

Griffin, et al., "A High Quality 9.6 Kbps Speech Coding System", Proc. ICASSP 86, Tokyo, Japan, (Apr. 13–20, 1986), pp. 125–128.

Griffin et al., "A New Model–Based Speech Analysis/Synthesis System", Proc. ICASSP 85, Tampa, FL (Mar.26–29, 1985), pp. 513–516.

Griffin, et al. "A New Pitch Detection Algorithm", Digital Signal Processing, No. 84, Elsevier Science Publishers (1984), pp. 395–399.

Griffin et al., "Multiband Excitation Vocoder" IEEE Transactions on Acoustics, Speech and Signal Processing, vol. 36, No. 8 (1988), pp. 1223–1235.

Griffin, "The Multiband Excitation Vocoder", Ph.D. Thesis, M.I.T., 1987.

Griffin et al. "Signal Estimation from Modified Short–Time Fourier Transform", IEEE Transactions on Acoustics, Speech, and Signal Processing, vol. ASSP–32, No. 2 (Apr. 1984), pp. 236–243.

Hardwick et al. "A 4.8 Kpbs Multi–band Excitation Speech Coder, " Proceedings from ICASSP, International Conference on Acoustics, Speech and Signal Processing, New York, N.Y. (Apr. 11–14, 1988), pp. 374–377.

Hardwick et al. "A 4.8 Kbps Multi–Band Excitation Speech Coder, " Master's Thesis, M.I.T., 1988.

Hardwick et al. "The Application of the IMBE Speech Coder to Mobile Communications," IEEE (1991), pp. 249–252.

Heron, "A 32–Band Sub–band/Transform Coder Imcorporating Vector Quantization for Dynamic Bit Allocation", IEEE (1983), pp. 1276–1279.

Levesque et al., "A Proposed Federal Standard for Narrowband Digital Land Mobile Radio", IEEE (1990), pp. 497–501.

Makhoul, "A Mixed–Source Model For Speech Compression And Synthesis", IEEE (1978), pp. 163–166.

Makhoul et al., "Vector Quantization in Speech Coding", Proc. IEEE (1985), pp. 1551–1588.

Maragos et al., "Speech Nonlinearities, Modulations, and Energy Operators", IEEE (1991), pp. 421–424.

Mazor et al., "Transform Subbands Coding With Channel Error Control", IEEE (1989), pp. 172–175.

McAulay et al., "Mid–Rate Coding Based on a Sinusoidal Representation of Speech", Proc. IEEE (1985), pp. 945–948.

McAulay et al., Multirate Sinusoidal Transform Coding at Rates From 2.4 Kbps to 8 Kbps., IEEE (1987), pp. 1645–1648.

McAulay et al., "Speech Analysis/Synthesis Based on A Sinusoidal Representation," IEEE Transactions on Acoustics, Speech and Signal Processing V. 34, No. 4, (Aug. 1986), pp. 744–754.

McCree et al., "A New Mixed Excitation LPC Vocoder", IEEE (1991), pp. 593–595.

McCree et al., "Improving The Performance Of A Mixed Excitation LPC Vocoder In Acoustic Noise", IEEE (1992), pp. 137–139.

Rahikka et al., "CELP Coding for Land Mobile Radio Applications," Proc. ICASSP 90, Albuquerque, New Mexico, Apr. 3–6, 1990, pp. 465–468.

Rowe et al., "A Robust 2400bit/s MBE–LPC Speech Coder Incorporating Joint Source and Channel Coding," IEEE (1992), pp. 141–144.

Secrest, et al., "Postprocessing Techniques for Voice Pitch Trackers", ICASSP, vol. 1 (1982), pp. 172–175.

Tribolet et al., Frequency Domain Coding of Speech, IEEE Transactions on Acoustics, Speech and Signal Processing, V. ASSP–27, No. 5, pp 512–530 (Oct. 1979).

Yu et al., "Discriminant Analysis and Supervised Vector Quantization for Continuous Speech Recognition", IEEE (1990), pp. 685–688.

* cited by examiner

JOINT QUANTIZATION OF SPEECH SUBFRAME VOICING METRICS AND FUNDAMENTAL FREQUENCIES

BACKGROUND

The invention is directed to encoding and decoding speech.

Speech encoding and decoding have a large number of applications and have been studied extensively. In general, one type of speech coding, referred to as speech compression, seeks to reduce the data rate needed to represent a speech signal without substantially reducing the quality or intelligibility of the speech. Speech compression techniques may be implemented by a speech coder.

A speech coder is generally viewed as including an encoder and a decoder.

The encoder produces a compressed stream oil bits from a digital representation of speech, such as may be generated by converting an analog signal produced by a microphone using an analog-to-digital converter. The decoder converts the compressed bit stream into a digital representation of speech that is suitable for playback through a digital-to-analog converter and a speaker. In many applications, the encoder and decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at high rates (greater than 8 kbps), mid-rates (3–8 kbps) and low rates (less than 3 kbps). Recently, mid-rate and low-rate speech coders have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Vocoders are a class of speech coders that have been shown to be highly applicable to mobile communications. A vocoder models speech as the response of a system to excitation over short time intervals. Examples of vocoder systems include linear prediction vocoders, homomorphic vocoders, channel vocoders, sinusoidal transform coders ("STC"), multiband excitation ("MBE") vocoders, and improved multiband excitation ("IMBE®") vocoders. In these vocoders, speech is divided into short segments (typically 10–40 ms) with each segment being characterized by a set of model parameters. These parameters typically represent a few basic elements of each speech segment, such as the segment's pitch, voicing state, and spectral envelope. A vocoder may use one of a number of known representations for each of these parameters. For example the pitch may be represented as a pitch period, a fundamental frequency, or a long-term prediction delay. Similarly the voicing state may be represented by one or more voicing metrics that may be used to represent the voicing state, such as, for example, a voicing probability measure, or a ratio of periodic to stochastic energy. The spectral envelope is often represented by an all-pole filter response, but also may be represented by a set of spectral magnitudes or other spectral measurements.

Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

One speech model which has been shown to provide high quality speech and to work well at medium to low bit rates is the multi-band excitation (MBE) speech model developed by Griffin and Lim. This model uses a flexible voicing structure that allows it to produce more natural sounding speech, and which makes it more robust to the presence of acoustic background noise. These properties have caused the MBE speech model to be employed in a number of commercial mobile communication applications.

The MBE speech model represents segments of speech using a fundamental frequency, a set of binary voiced/unvoiced (V/UV) metrics or decisions, and a set of spectral magnitudes. The MBE model generalizes the traditional single V/UV decision per segment into a set of decisions, each representing the voicing state within a particular frequency band. This added flexibility in the voicing model allows the MBE model to better accommodate mixed voicing sounds, such as some voiced fricatives.

This added flexibility also allows a more accurate representation of speech that has been corrupted by acoustic background noise. Extensive testing has shown that this generalization results in improved voice quality and intelligibility.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder converts the received bit stream back into individual frames. As part of this conversion, the decoder may perform deinterleaving and error control decoding to correct or detect bit errors. The decoder then uses the frames of bits to reconstruct the MBE model parameters, which the decoder uses to synthesize a speech signal that perceptually resembles the original speech to a high degree. The decoder may synthesize separate voiced and unvoiced components, and then may add the voiced and unvoiced components to produce the final speech signal.

In MBE-based systems, the encoder uses a spectral magnitude to represent the spectral envelope at each harmonic of the estimated fundamental frequency. The encoder then estimates a spectral magnitude for each harmonic frequency. Each harmonic is designated as being either voiced or unvoiced, depending upon whether the frequency band containing the corresponding harmonic has been declared voiced or unvoiced. When a harmonic frequency has been designated as being voiced, the encoder may use a magnitude estimator that differs from the magnitude estimator used when a harmonic frequency has been designated as being unvoiced. At the decoder, the voiced and unvoiced harmonics are identified, and separate voiced and unvoiced components are synthesized using different procedures. The unvoiced component may be synthesized using a weighted overlap-add method to filter a white noise signal. The filter used by the method sets to zero all frequency bands designated as voiced while otherwise matching the spectral magnitudes for regions designated as unvoiced. The voiced component is synthesized using a tuned oscillator bank, with one oscillator assigned to each harmonic that has been designated as being voiced. The instantaneous amplitude, frequency and phase are interpolated to match the corresponding parameters at neighboring segments.

MBE-based speech coders include the IMBE® speech coder and the AMBE® speech coder. The AMBE® speech coder was developed as an improvement on earlier MBE-based techniques and includes a more robust method of estimating the excitation parameters (fundamental frequency and voicing decisions). The method is better able to track the variations and noise found in actual speech. The AMBE® speech coder uses a filter bank that typically includes sixteen channels and a non-linearity to produce a set of channel outputs from which the excitation parameters can be reliably estimated. The channel outputs are combined and processed to estimate the fundamental frequency. Thereafter, the channels within each of several (e.g., eight) voicing bands are processed to estimate a voicing decision (or other voicing metrics) for each voicing band.

The AMBE® speech coder also may estimate the spectral magnitudes independently of the voicing decisions. To do this, the speech coder computes a fast Fourier transform ("FFT") for each windowed subframe of speech and averages the energy over frequency regions that are multiples of the estimated fundamental frequency. This approach may further include compensation to remove from the estimated spectral magnitudes artifacts introduced by the FFT sampling grid.

The AMBE® speech coder also may include a phase synthesis component that regenerates the phase information used in the synthesis of voiced speech without explicitly transmitting the phase information from the encoder to the decoder. Random phase synthesis based upon the voicing decisions may be applied, as in the case of the IMBE® speech coder. Alternatively, the decoder may apply a smoothing kernel to the reconstructed spectral magnitudes to produce phase information that may be perceptually closer to that of the original speech than is the randomly-produced phase information.

The techniques noted above are described, for example, in Flanagan, *Speech Analysis Synthesis and Perception*, Springer-Verlag, 1972, pages 378–386 (describing a frequency-based speech analysis-synthesis system); Jayant et al., *Digital Coding of Waveforms*, Prentice-Hall, 1984 (describing speech coding in general); U.S. Pat. No. 4,885,790 (describing a sinusoidal processing method); U.S. Pat. No. 5,054,072 (describing a sinusoidal coding method); Almeida et al., "Nonstationary Modeling of Voiced Speech", *IEEE TASSP*, Vol. ASSP-31, No. 3, Jun. 1983, pages 664–677 (describing harmonic modeling and an associated coder); Almeida et al., "Variable-Frequency Synthesis: An Improved Harmonic Coding Scheme", *IEEE Proc. ICASSP* 84, pages 27.5.1–27.5.4 (describing a polynomial voiced synthesis method); Quatieri et al., "Speech Transformations Based on a Sinusoidal Representation", *IEEE TASSP*, Vol. ASSP34, No. 6, December 1986, pages 1449–1986 (describing an analysis-synthesis technique based on a sinusoidal representation); McAulay et al., "Mid-Rate Coding Based on a Sinusoidal Representation of Speech", Proc. *ICASSP* 85, pages 945–948, Tampa, Fla., Mar. 26–29, 1985 (describing a sinusoidal transform speech coder); Griffin, "Multiband Excitation Vocoder", Ph.D. Thesis, M.I.T, 1987 (describing the MBE speech model and an 8000 bps MBE speech coder); Hardwick, "A 4.8 kbps Multi-Band Excitation Speech Coder", SM. Thesis, M.I.T, May 1988 (describing a 4800 bps MBE speech coder); Telecommunications Industry Association (TIA), "APCO Project 25 Vocoder Description", Version 1.3, Jul. 15, 1993, IS102BABA (describing a 7.2 kbps IMBE® speech coder for APCO Project 25 standard); U.S. Pat. No. 5,081,681 (describing IMBE® random phase synthesis); U.S. Pat. No. 5,247,579 (describing a channel error mitigation method and format enhancement method for MBE-based speech coders); U.S. Pat. No. 5,226,084 (describing quantization and error mitigation methods for MBE-based speech coders); and U.S. Pat. No. 5,517,511 (describing bit prioritization and FEC error control methods for MBE-based speech coders.

SUMMARY

The invention features a speech coder for use, for example, in a wireless communication system to produce high quality speech from a bit stream transmitted across a wireless communication channel at a low data rate. The speech coder combines low data rate, high voice quality, and robustness to background noise and channel errors. The speech coder achieves high performance through a multi-subframe voicing metrics quantizer that jointly quantizes voicing metrics estimated from two or more consecutive subframes. The quantizer achieves fidelity comparable to prior systems while using fewer bits to quantize the voicing metrics. The speech coder may be implemented as an AMBE® speech coder. AMBE® speech coders are described generally in U.S. application Ser. No. 08/222,119, filed Apr. 4, 1994 and entitled "ESTIMATION OF EXCITATION PARAMETERS" which issued on Feb. 3, 1998 as U.S. Pat. No. 5,715,365; and U.S. application SER. No. 08/392,188, filed Feb. 22, 1995 and entitled "SPECTRAL MAGNITUDE REPRESENTATION FOR MULTI-BAND EXCITATION SPEECH CODERS" which issued on May. 19, 1998 as U.S. Pat. No. 5,754,974; and U.S. application SER. No. 08/392,099, filed Feb. 22, 1995 and entitled "SYNTHESIS OF MBE-BASED CODED SPEECH USING REGENERATED PHASE INFORMATION" which issued on Dec. 23, 1997 as U.S. Pat. No. 5,701,390, all of which are incorporated by reference.

In one aspect, generally, speech is encoded into a frame of bits. A speech signal is digitized into a sequence of digital speech samples. A set of voicing metrics parameters is estimated for a group of digital speech samples, with the set including multiple voicing metrics parameters. The voicing metrics parameters then are jointly quantized to produce a set of encoder voicing metrics bits. Thereafter, the encoder voicing metrics bits are included in a frame of bits.

Implementations may include one or more of the following features. The digital speech samples may be divided into a sequence of subframes, with each of the subframes including multiple digital speech samples, and subframes from the sequence may be designated as corresponding to a frame. The group of digital speech samples may correspond to the subframes for a frame. Jointly quantizing multiple voicing metrics parameters may include jointly quantizing at least one voicing metrics parameter for each of multiple subframes, or jointly quantizing multiple voicing metrics parameters for a single subframe.

The joint quantization may include computing voicing metrics residual parameters as the transformed ratios of voicing error vectors and voicing energy vectors. The residual voicing metrics parameters from the subframes may be combined and combined residual parameters may be quantized.

The residual parameters from the subframes of a frame may be combined by performing a linear transformation on the residual parameters to produce a set of transformed residual coefficients for each subframe that then are combined. The combined residual parameters may be quantized using a vector quantizer.

The frame of bits may include redundant error control bits protecting at least some of the encoder voicing metrics bits. Voicing metrics parameters may represent voicing states estimated for an MBE-based speech model.

Additional encoder bits may be produced by jointly quantizing speech model parameters other than the voicing metrics parameters. The additional encoder bits may be included in the frame of bits. The additional speech model parameters include parameters representative of the spectral magnitudes and fundamental frequency.

In another general aspect, fundamental frequency parameters of subframes of a frame are jointly quantized to produce a set of encoder fundamental frequency bit that are included in a frame of bits. The joint quantization may include computing residual fundamental frequency parameters as the difference between the transformed average of the fundamental frequency parameters and each fundamental frequency parameter. The residual fundamental frequency parameters from the subframes may be combined and the combined residual parameters may be quantized.

The residual fundamental frequency parameters may be combined by performing a linear transformation on the residual parameters to produce a set of transformed residual coefficients for each subframe. The combined residual parameters may be quantized using a vector quantizer.

The frame of bits may include redundant error control bits protecting at least some of the encoder fundamental frequency bits. The fundamental frequency parameters may represent log fundamental frequency estimated for a MBE-based speech model.

Additional encoder bits may be produced by quantizing speech model parameters other than the voicing metrics parameters. The additional encoder bits may be included in the frame of bits.

In another general aspect, a fundamental frequency parameter of a subframe of a frame is quantized, and the quantized fundamental frequency parameter is used to interpolate a fundamental frequency parameter for another subframe of the frame. The quantized fundamental frequency parameter and the interpolated fundamental frequency parameter then are combined to produce a set of encoder fundamental frequency bits.

In yet another general aspect, speech is decoded from a frame of bits that has been encoded as described above. Decoder voicing metrics bits are extracted from the frame of bits and used to jointly reconstruct voicing metrics parameters for subframes of a frame of speech. Digital speech samples for each subframe within the frame of speech are synthesized using speech model parameters that include some or all of the reconstructed voicing metrics parameters for the subframe.

Implementations may include one or more of the following features. The joint reconstruction may include inverse quantizing the decoder voicing metrics bits to reconstruct a set of combined residual parameters for the frame. Separate residual parameters may be computed for each subframe from the combined residual parameters. The voicing metrics parameters may be formed from the voicing metrics bits.

The separate residual parameters for each subframe may be computed by separating the voicing metrics residual parameters for the frame from the combined residual parameters for the frame. An inverse transformation may be performed on the voicing metrics residual parameters for the frame to produce the separate residual parameters for each subframe. The separate voicing metrics residual parameters may be computed from the transformed residual parameters by performing an inverse vector quantizer transform on the voicing metrics decoder parameters.

The frame of bits may include additional decoder bits that are representative of speech model parameters other than the voicing metrics parameters. The speech model parameters include parameters representative of spectral magnitudes, fundamental frequency, or both spectral magnitudes and fundamental frequency.

The reconstructed voicing metrics parameters may represent voicing metrics used in a Multi-Band Excitation (MBE) speech model. The frame of bits may include redundant error control bits protecting at least some of the decoder voicing metrics bits. Inverse vector quantization may be applied to one or more vectors to reconstruct a set of combined residual parameters for the frame.

In another aspect, speech is decoded from a frame of bits that has been encoded as described above. Decoder fundamental frequency bits are extracted from the frame of bits. Fundamental frequency parameters for subframes of a frame of speech are jointly reconstructed using the decoder fundamental frequency bits. Digital speech samples are synthesized for each subframe within the frame of speech using speech model parameters that include the reconstructed fundamental frequency parameters for the subframe.

Implementations may include the following features. The joint reconstruction may include inverse quantizing the decoder fundamental frequency bits to reconstruct a set of combined residual parameters for the frame. Separate residual parameters may be computed for each subframe from the combined residual parameters. A log average fundamental frequency residual parameter may be computed for the frame and a log fundamental frequency differential residual parameter may be computed for each subframe. The separate differential residual parameters may be added to the log average fundamental frequency residual parameter to form the reconstructed fundamental frequency parameter for each subframe within the frame.

The described techniques may be implemented in computer hardware or software, or a combination of the two. However, the techniques are not limited to any particular hardware or software configuration; they may find applicability in any computing or processing environment that may be used for encoding or decoding speech. The techniques may be implemented as software executed by a digital signal processing chip and stored, for example, in a memory device associated with the chip. The techniques also may be implemented in computer programs executing on programmable computers that each include a processor, a storage medium readable by the processor (including volatile and non-volatile memory and/or storage elements), at least one input device, and two or more output devices. Program code is applied to data entered using the input device to perform the functions described and to generate output information. The output information is applied to one or more output devices.

Each program may be implemented in a high level procedural or object oriented programming language to communicate with a computer system. The programs also can be implemented in assembly or machine language, if desired. In any case, the language may be a compiled or interpreted language.

Each such computer program may be stored on a storage medium or device (e.g., CD-ROM, hard disk or magnetic diskette) that is readable by a general or special purpose programmable computer for configuring and operating the computer when the storage medium or device is read by the computer to perform the procedures described in this document. The system may also be considered to be implemented as a computer-readable storage medium, configured with a computer program, where the storage medium so configured causes a computer to operate in a specific and predefined manner.

Other features and advantages will be apparent from the following description, including the drawings, and from the claims.

DESCRIPTION

Figure 1:
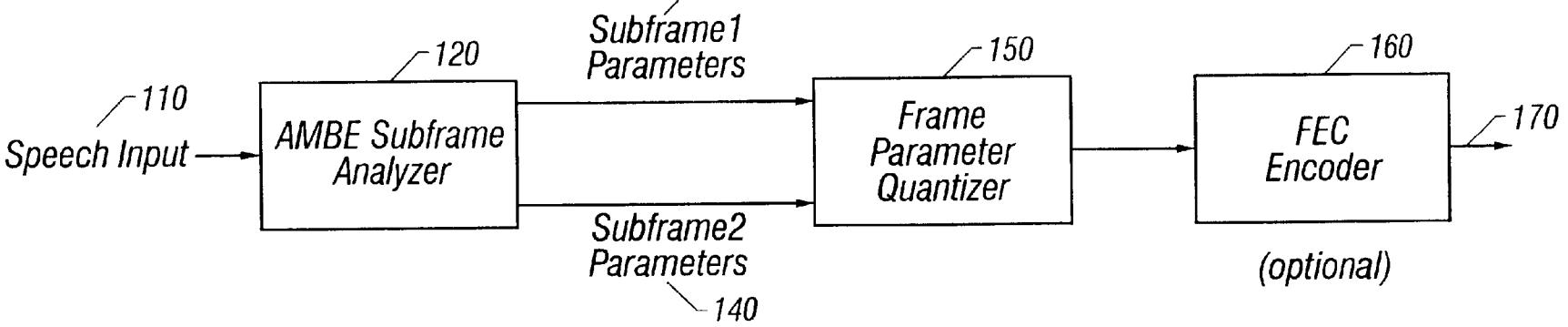
FIG. 1 is a block diagram of an AMBE® vocoder system.

An implementation is described in the context of a new AMBE® speech coder, or vocoder, which is widely applicable to wireless communications, such as cellular or satellite telephony, mobile radio, airphones, and voice pagers, to wireline communications such as secure telephony and voice multiplexors, and to digital storage of speech such as in telephone answering machines and dictation equipment. Referring to FIG. 1, the AMBE® encoder processes sampled input speech to produce an output bit stream by first analyzing the input speech 110 using an AMBE® Analyzer 120, which produces sets of subframe parameters every 5–30 ms. Subframe parameters from two consecutive subframes, 130 and 140, are fed to a Frame Parameter Quantizer 150. The parameters then are quantized by the Frame Parameter Quantizer 150 to form a frame of quantized output bits. The output of the Frame Parameter Quantizer 150 is fed into an optional Forward Error Correction (FEC) encoder 160. The bit stream 170 produced by the encoder may be transmitted through a channel or stored on a recording medium. The error coding provided by FEC encoder 160 can correct most errors introduced by the transmission channel or recording medium. In the absence of errors in the transmission or storage medium, the FEC encoder 160 may be reduced to passing the bits produced by the Frame Parameter Quantizer 150 to the encoder output 170 without adding further redundancy.

Figure 2:
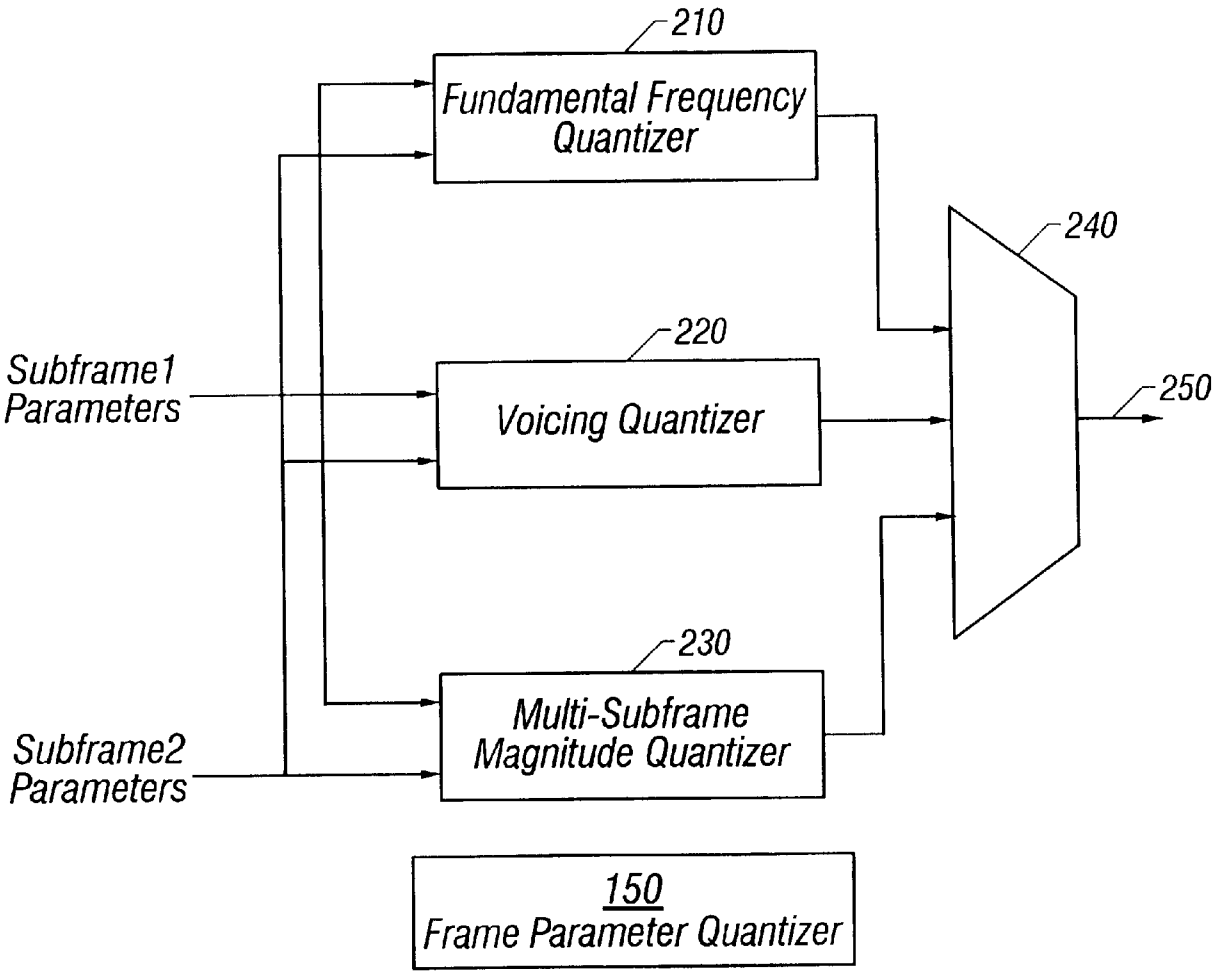
FIG. 2 is a block diagram of a joint parameter quantizer.

FIG. 2 shows a more detailed block diagram of the Frame Parameter Quantizer 150. The fundamental frequency parameters of the two consecutive subframes are jointly quantized by a fundamental frequency quantizer 210. In particular, the fundamental frequency quantizer 210 quantizes the parameters together in a single quantization step. The voicing metrics of the subframes are processed by a voicing quantizer 220. The spectral magnitudes of the subframes are processed by a magnitude quantizer 230. The quantized bits are combined in a combiner 240 to form the output 250 of the Frame Parameter Quantizer.

Figure 3:
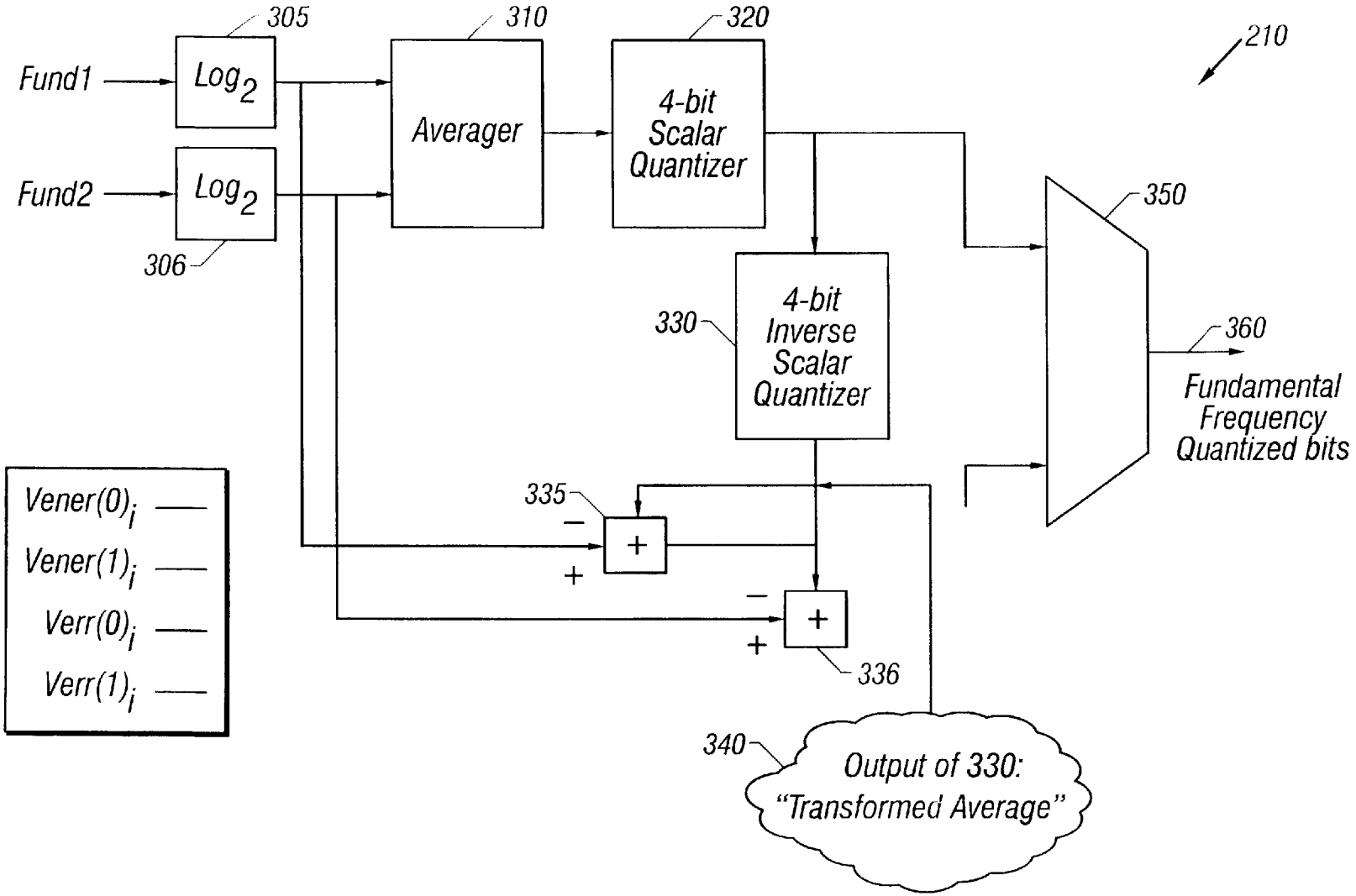
FIG. 3 is a block diagram of a fundamental frequency quantizer.

FIG. 3 shows an implementation of a joint fundamental frequency quantizer. The two fundamental frequency parameters received by the fundamental frequency quantizer 210 are designated as fund1 and fund2. The quantizer 210 uses log processors 305 and 306 to generate logarithms (typically base 2) of the fundamental frequency parameters. The outputs of the log processors 305 ($\log_2$(fund1)) and 306 ($\log_2$(fund2)) are averaged by an averager 310 to produce an output that may be expressed as 0.5 ($\log_2$(fund1)+$\log_2$(fund2)). The output of the average 310 is quantized by a 4 bit scalar quantizer 320, although variation in the number of bits is readily accommodated. Essentially, the scalar quantizer 320 maps the high precision output of the averager 310, which may be, for example, 16 or 32 bits long, to a 4 bit output associated with one of 16 quantization levels. This 4 bit number representing a particular quantization level can be determined by comparing each of the 16 possible quantization levels to the output of the averager and selecting the one which is closest as the quantizer output. Optionally if the scalar quantizer is a scalar uniform quantizer, the 4 bit output can be determined by dividing the output of the averager plus an offset by a predetermined step size Δ and rounding to the nearest integer within an allowable range determined by the number of bits.

A typical formula used for 4 bit scalar uniform quantization is:

$$\Delta = \frac{6.21}{62 \cdot 2^{N-6} - 0.5}$$

$$\text{step} = \frac{-0.5 \cdot [\log_2(fund1) + \log_2(fund2)] - 4.312}{\Delta}$$

$$\text{bits} = \begin{cases} 0, & \text{step} < 0 \\ 14, & \text{step} \geq 14 \\ \text{step}, & \text{otherwise} \end{cases}$$

The output, bits, computed by the scalar quantizer is passed through a combiner 350 to form the 4 most significant bits of the output 360 of the fundamental frequency quantizer.

The 4 output bits of the quantizer 320 also are input to a 4-bit inverse scalar quantizer 330, which produces a transformed average by converting these 4 bits back into its associated quantization level which is also a high precision value similar to the output of the averager 310. This conversion process can be performed via a table look up where each possibility for the 4 output bits is associated with a single quantization level. Optionally if the inverse scalar quantizer is a uniform scalar quantizer the conversion can be accomplished by multiplying the four bit number by the predetermined step size Δ and adding an offset to compute the output quantization ql as follows:

$$ql = -(\text{bits}+0.5)\cdot\Delta - 4.312$$

where Δ is the same as used in the quantizer 320. Subtraction blocks 335 and 336 subtract the transformed average output of the inverse quantizer 330 from $\log_2$(fund1) and $\log_2$(fund2) to produce a 2 element difference vector input to a 6-bit vector quantizer 340.

The two inputs to the 6-bit vector quantizer 340 are treated as a two-dimensional difference vector: (z0, z1), where the components z0 and z1 represent the difference elements from the two subframes (i.e. the 0'th followed by the 1'st subframe) contained in a frame. This two-dimensional vector is compared to a two-dimensional vector (x0(i), x1(i)) in a table such as the one in Appendix A, "Fundamental Frequency VQ Codebook (6-bit)." The comparison is based on a distance measure, e(i), which is typically calculated as:

$$e(i)=w0*[x0(i)-z0]^2+w1*[x1(i)-z1]^2 \text{ for } i=0, 1, \ldots, 63.$$

where w0 and w1 are weighting values that lower the error contribution for an element from a subframe with more voiced energy and increase the error contribution for an element from a subframe with less voiced energy. Preferred weights are computed as:

$$w0=\sum_{i=0}^{7}[vener_i(0)-verr_i(0)]+C\cdot[vener_i(0)+vener_i(1)]$$

$$w1=\sum_{i=0}^{7}[vener_i(1)-verr_i(1)]+C\cdot[vener_i(0)+vener_i(1)]$$

where C=constant with a preferred value of 0.25. The variables $vener_i(0)$ and $vener_i(1)$ represent the voicing energy terms for the 0'th and 1'st subframes, respectively, for the i'th frequency band, while the variables $verr_i(0)$ and $verr_i(1)$ represent the voicing error terms for the 0'th and 1'st subframes, respectively, for the i'th frequency band. The index i of the vector that minimizes e(i) is selected from the table to produce the 6-bit output of the vector quantizer 340.

The vector quantizer reduces the number of bits required to encode the fundamental frequency by providing a reduced number of quantization patterns for a given two-dimensional vector. Empirical data indicates that the fundamental frequency does not vary significantly from subframe to subframe for a given speaker, so the quantization patterns provided by the table in Appendix A are more densely clustered about smaller values of x0(n) and x1(n). The vector quantizer can more accurately map these small changes in fundamental frequency between subframes, since there is a higher density of quantization levels for small changes in fundamental frequency.

Therefore, the vector quantizer reduces the number of bits required to encode the fundamental frequency without significant degradation in speech quality.

The output of the 6-bit vector quantizer 340 is combined with the output of the 4-bit scalar quantizer 320 by the combiner 350. The four bits from the scalar quantizer 320 form the most significant bits of the output 360 of the fundamental frequency quantizer 210 and the six bits from the vector quantizer 340 form the less significant bits of the output 360.

Figure 4:
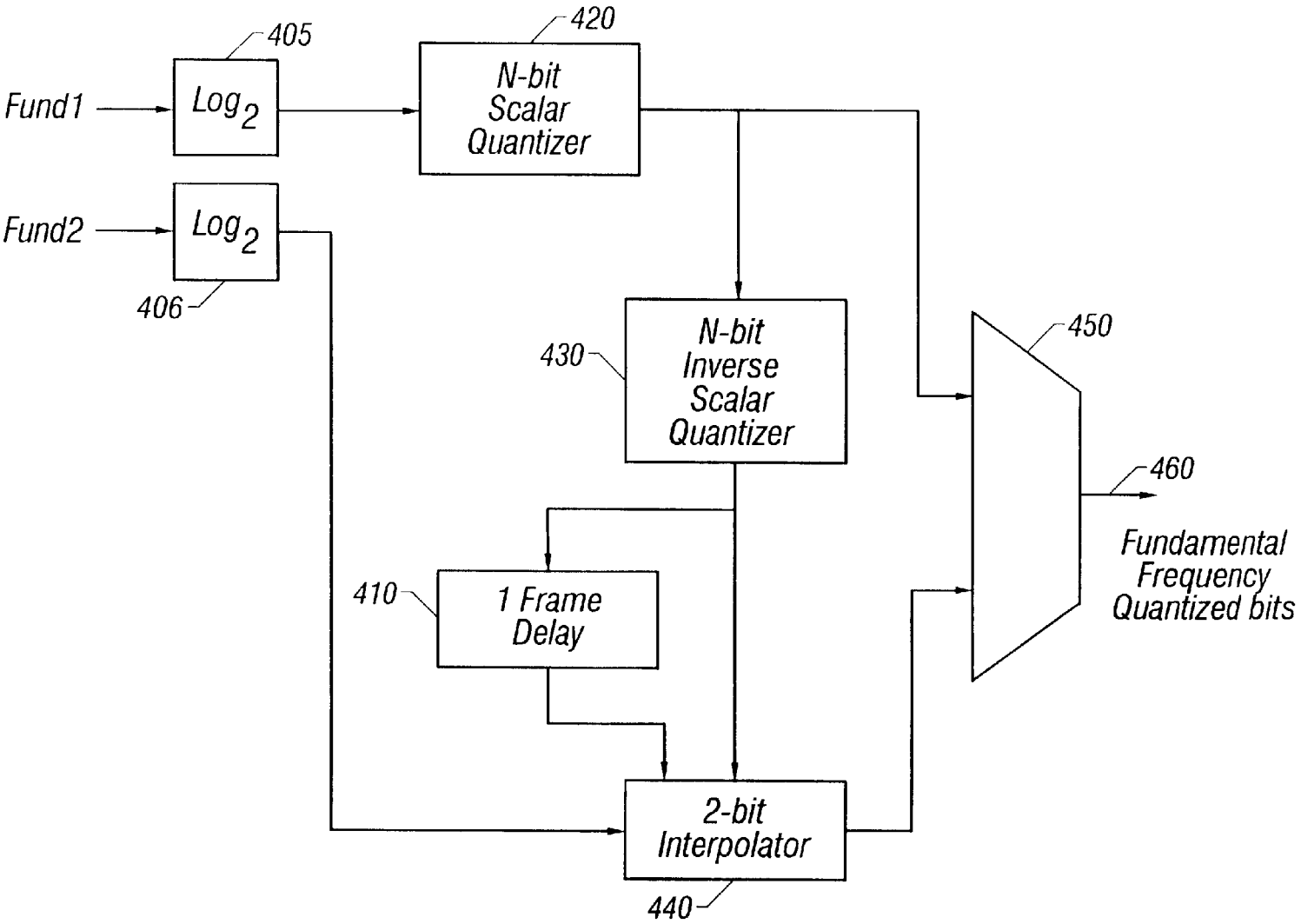
FIG. 4 is a block diagram of an alternative fundamental frequency quantizer.

A second implementation of the joint fundamental frequency quantizer is shown in FIG. 4. Again the two fundamental frequency parameters received by the fundamental frequency quantizer 210 are designated as fund1 and fund2. The quantizer 210 uses log processors 405 and 406 to generate logarithms (typically base 2) of the fundamental frequency parameters. The output of the log processors 405 for the second subframe $\log_2$(fund1) is scalar quantized 420 using N=4 to 8 bits (N=6 is commonly used). Typically a uniform scalar quantizer is applied using the following formula:

$$\Delta=\frac{6.21}{62\cdot 2^{N-6}-0.5}$$

$$\text{step}=\frac{-\log_2(fund1)-4.312}{\Delta}$$

$$\text{bits}=\begin{cases}0, & \text{step}<0\\ 62\cdot 2^{N-6}-1, & \text{step}\geq 62\cdot 2^{N-6}-1\\ \text{step}, & \text{otherwise}\end{cases}$$

A non-uniform scalar quantizer consisting of a table of quantization levels could also be applied. The output bits are passed to the combiner 450 to form the N most significant bits of the output 460 of the fundamental frequency quantizer. The output bits are also passed to an inverse scalar quantizer 430 which outputs a quantization level corresponding to $\log_2$(fund1) which is reconstructed from the input bits according to the following formula:

$$ql(0)=-(\text{bits}+0.5)\cdot\Delta-4.312$$

The reconstructed quantization level for the current frame ql(0) is input to a one frame delay element 410 which outputs the similar value from the prior frame (i.e. the quantization level corresponding to the second subframe of the prior frame). The current and delayed quantization level, designated ql(−1), are both input to a 2 bit or similar interpolator which selects the one of four possible outputs which is closest to $\log_2$(fund2) from the interpolation rules shown in Table 1. Note different rules are used if ql(0)=ql(−1) than otherwise in order to improve quantization accuracy in this case.

TABLE 1

2 Bit Fundamental Quantizer Interpolator

| index (i) | Interpolation rule if: ql(0) ≠ ql(−1) | Interpolation rule if: ql(0) = ql(−1) |
|---|---|---|
| 0 | ql(0) | ql(0) |
| 1 | .35 · ql(−1) + .65 · ql(0) | ql(0) |
| 2 | .5 · ql(−1) + .5 · ql(0) | q1(0) − Δ/2 |
| 3 | ql(−1) | ql(0) − Δ/2 |

The 2 bit index i of the interpolation rule which produces a result closest to $\log_2$(fund2) is output from the interpolator 440, and input to the combiner 450 where they form the 2 LSB's of the output of the fundamental frequency quantizer 460.

Figure 5:
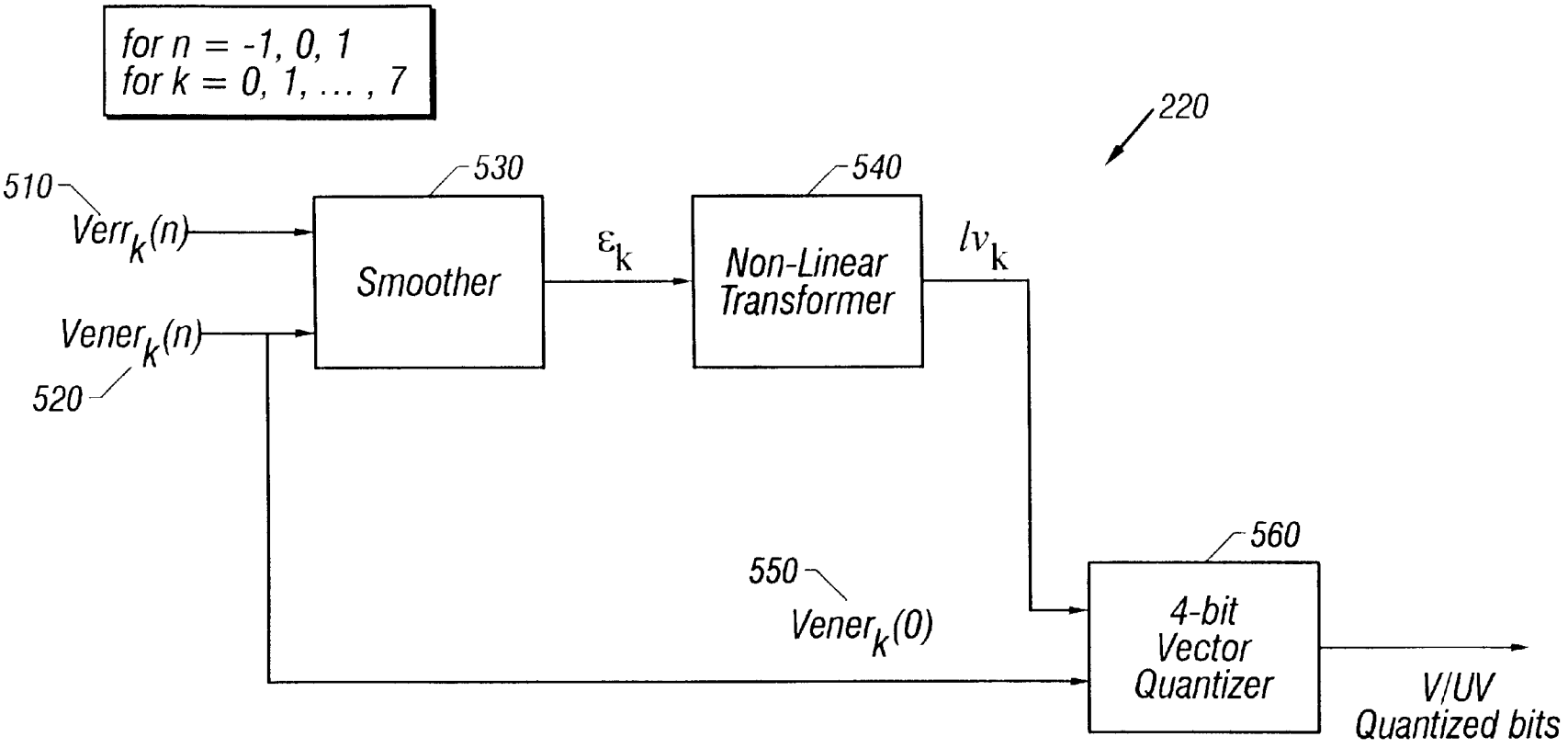
FIG. 5 is a block diagram of a voicing metrics quantizer.

Referring to FIG. 5, the voicing metrics quantizer 220 performs joint quantization of voicing metrics for consecutive subframes. The voicing metrics may be expressed as the function of a voicing energy 510, $vener_k(n)$, representative of the energy in the k'th frequency band of the n'th subframe, and a voicing error term 520, $verr_k(n)$, representative of the energy at non-harmonic frequencies in the k'th frequency band of the n'th subframe. The variable n has a value of −1 for the last subframe of the previous frame, 0 and 1 for the two subframes of the current frame, and 2 for the first subframe of the next subframe (if available due to delay considerations). The variable k has values of 0 through 7 that correspond to eight discrete frequency bands.

A smoother 530 applies a smoothing operation to the voicing metrics for each of the two subframes in the current frame to produce output values $\epsilon_k(0)$ and $\epsilon_k(1)$. The values of $\epsilon_k(0)$ are calculated as:

$$\epsilon_k(0) = \frac{\min\left[\frac{verr_k(0)}{vener_k(0)}, \max\left(\frac{verr_k(-1)}{vener_k(-1)}, \frac{verr_k(1)}{vener_k(1)}\right)\right]}{T}$$

for $k = 0, 1, \ldots, 7$;

and the values of $\epsilon_k(1)$ are calculated in one of two ways. If $vener_k(2)$ and $verr_k(2)$ have been precomputed by adding one additional subframe of delay to the voice encoder, the values of $\epsilon_k(1)$ are calculated as:

$$\epsilon_k(1) = \frac{\min\left[\frac{verr_k(1)}{vener_k(1)}, \max\left(\frac{verr_k(0)}{vener_k(0)}, \frac{verr_k(2)}{vener_k(2)}\right)\right]}{T}$$

for $k = 0, 1, \ldots, 7$;

If $vener_k(2)$ and $verr_k(2)$ have not been precomputed, the values of $\epsilon_k(1)$ are calculated as:

$$\epsilon_k(1) = \left[\frac{verr_k(1)}{T \cdot vener_k(1)}\right] \times \min\left[1.0, \max\left(\frac{verr_k(0)}{T \cdot vener_k(0)}, \beta\right)\right]$$

for $k = 0, 1, \ldots, 7$;

where T is a voicing threshold value and has a typical value of 0.2 and where β is a constant and has a typical value of 0.67.

The output values $\epsilon_k$ from the smoother 530 for both subframes are input to a non-linear transformer 540 to produce output values $l_k$ as follows:

$$d_0(n) = \sum_{k=0}^{7} vener_k(n)$$

$$d_1(n) = \sum_{k=0}^{7} vener_k(n)\cos[\pi(k+0.5)/8]$$

$$\rho(n) = \begin{cases} 1.0 & \text{if } (d_1(n) < -0.5 \cdot d_0(n)) \\ 0.5 & \text{otherwise} \end{cases}$$

$$lv_k(n) = \max\{0.0, \min[1.0, \rho(n) - \gamma\log_2(\epsilon_k(n))]\}$$

for $k = 0, 1, \ldots, 7 \quad n = 0, 1$ where a typical value for γ is 0.5 and optionally ρ(n) may be simplified and set equal to a constant value of 0.5, eliminating the need to compute $d_0(n)$ and $d_1(n)$.

The 16 elements $lv_k(n)$ for k=0,1 . . . 7 and n=0,1, which are the output of the non-linear transformer for the current frame, form a voicing vector. This vector along with the corresponding voicing energy terms 550, $vener_k(0)$, are next input to a vector quantizer 560. Typically one of two methods is applied by the vector quantizer 560, although many variations can be employed.

In a first method, the vector quantizer quantizes the entire 16 element voicing vector in single step. The vector quantizer processes and compares its input voicing vector to every possible quantization vector $x_j(i)$, j=0,1, . . . , 15 in an associated codebook table such as the one in Appendix B, "16 Element Voicing Metric VQ Codebook (6-bit)". The number of possible quantization vectors compared by the vector quantizer is typically $2^N$, where N is the number of bits output by that vector quantizer (typically N=6). The comparison is based on the weighted square distance, e(i), which is calculated for an N bit vector quantizer as follows:

$$e(i) = \sum_{j=0}^{7} vener_j(o) \cdot [x_j(i) - lv_j(0)]^2 + \sum_{j=0}^{7} vener_j(1) \cdot [x_{j+8}(i) - lv_j(1)]^2$$

for $i = 0, 1, \ldots, 2^N - 1$

The output of the vector quantizer 560 is an N bit index, i, of the quantization vector from the codebook table that is found to minimize e(i), and the output of the vector quantizer forms the output of the voicing quantizer 220 for each frame.

In a second method, the vector quantizer splits the voicing vector into subvectors, each of which is vector quantized individually. By splitting the large vector into subvectors prior to quantization, the complexity and memory requirements of the vector quantizer are reduced. Many different splits can be applied to create many variations in the number and length of the subvectors (e.g. 8+8, 5+5+6, 4+4+4+4, . . . ). One possible variation is to divide the voicing vector into two 8-element subvectors: $lv_k(0)$ for k=0,1 . . . 7 and $lv_k(1)$ for k=0,1 . . . 7. This effectively divides the voicing vector into one subvector for the first subframe and another subvector for the second subframe. Each subvector is vector quantized independently to minimize $e_n(i)$, as follows, for an N bit vector quantizer:

$$e_n(i) = \sum_{j=0}^{7} vener_j(n) \cdot [x_j(i) - lv_j(n)]^2$$

for $i = 0, 1, \ldots, 2^N - 1$ where n=0,1. Each of the $2^N$ quantization vectors, $x_j(i)$, for i=0,1, . . . , $2^N-1$, are 8 elements long (i.e. j=0,1, . . . , 7). One advantage of splitting the voicing vector evenly by subframes is that the same codebook table can be used for vector quantizing both subvectors, since the statistics do not generally vary between the two subframes within a frame. An example 4 bit codebook is shown in Appendix C, "8 Element Voicing Metric Split VQ Codebook (4-bit)". The output of the vector quantizer 560, which is also the output of the voicing quantizer 220, is produced by combining the bits output from the individual vector quantizers which in the splitting approach outputs 2N bits assuming N bits are used vector quantize each of the two 8 element subvectors.

Figure 6:
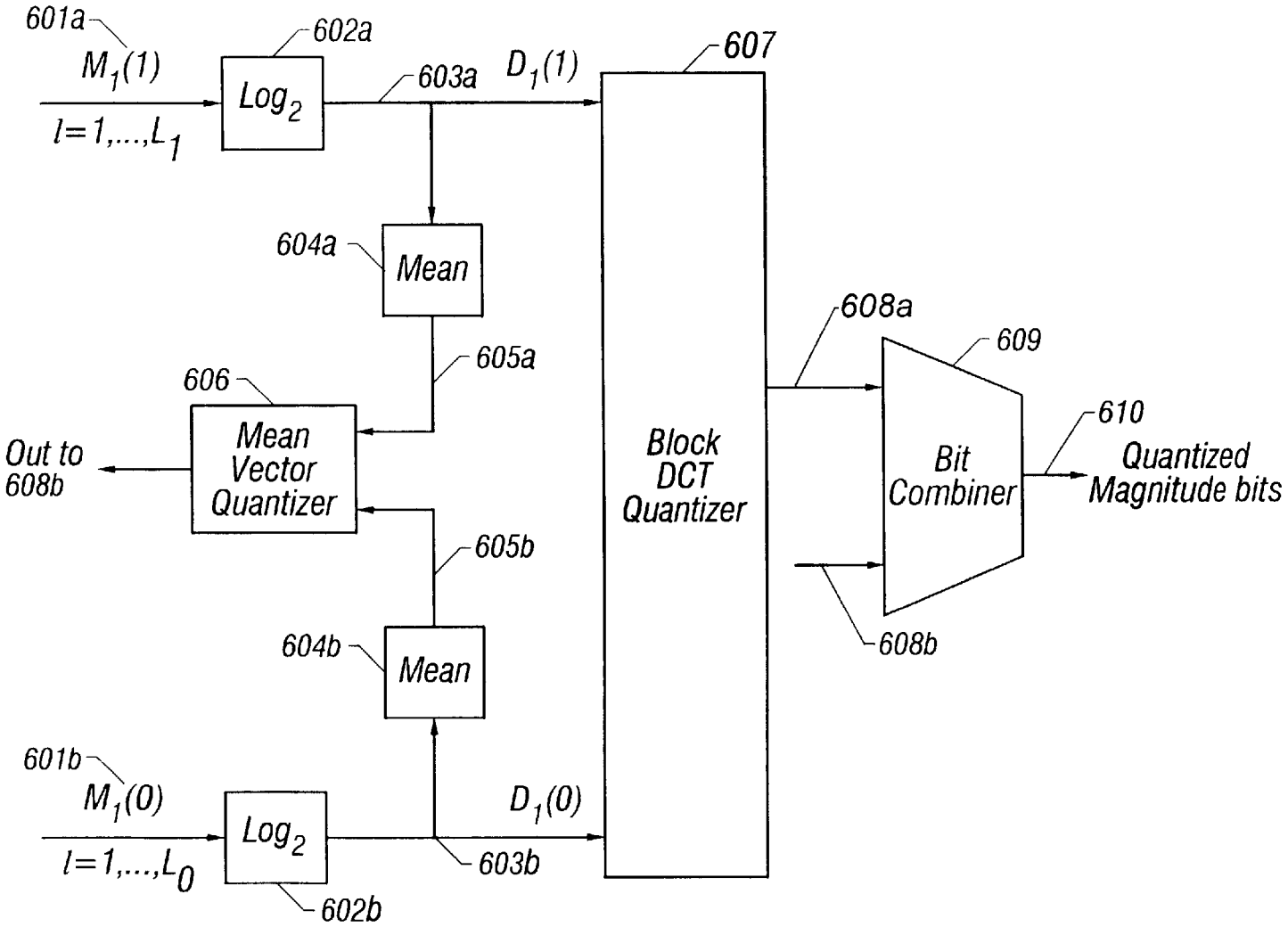
FIG. 6 is a block diagram of a multi-subframe spectral magnitude quantizer.

The new fundamental and voicing quantizers can be combined with various methods for quantizing the spectral magnitudes. As shown in FIG. 6, the magnitude quantizer 230 receives magnitude parameter 601*a* and 601*b* from the AMBE® analyzer for two consecutive subframes. Parameter 601*a* represents the spectral magnitudes for an odd numbered subframe (i.e. the last subframe of the frame) and is given an index of 1. The number of magnitude parameters for the odd-numbered subframe is designated by $L_1$. Parameter 601*b* represents the spectral magnitudes for an even numbered subframe (i.e. the first subframe of the frame) and is given the index of 0. The number of magnitude parameters for the even-numbered subframe is designated by $L_0$.

Parameter 601*a* passes through a logarithmic compander 602*a*, which performs a log base 2 operation on each of the $L_1$ magnitudes contained in parameter 601*a* and generates signal 603*a*, which is a vector with $L_1$ elements:

$$y[i]=\log_2(x,[i]) \text{ for } i=1, 2, \ldots, L_1$$

where x[i] represents parameter 1*a* and y[i] represents signal 603*a*. Compander 602*b* performs the log base 2 operation on each of the $L_0$ magnitudes contained in parameter 601*b* and generates signal 603*b*, which is a vector with $L_0$. elements:

$$y[i]=\log_2(x[i]) \text{ for } i=1, 2, \ldots, L_0$$

where x[i] represents parameter 601*b* and y[i] represents signal 603*b*.

Mean calculators 604*a* and 604*b* receive signals 603*a* and 603*b* produced by the companders 602*a* and 602*b* and calculate means 605*a* and 605*b* for each subframe. The mean, or gain value, represents the average speech level for the subframe and is determined by computing the mean of the log spectral magnitudes for the subframes and adding an offset dependent on the number of harmonics within the subframe.

For signal 603*a*, the mean is calculated as:

$$y_1 = \frac{1}{L_1}\sum_{i=1}^{L_1} x[i] + 0.5 \cdot \log_2(L_1)$$

where the output, $y_1$, represents the mean signal 5*a* corresponding to the last subframe of each frame. For signal 603*b*, the mean is calculated as:

$$y_0 = \frac{1}{L_0}\sum_{i=1}^{L_0} x[i] + 0.5 \cdot \log_2(L_0)$$

where the output, $y_0$, represents the mean signal 605*b* corresponding to the first subframe of each frame.

The mean signals 605*a* and 605*b* are quantized by a mean vector quantizer 606 that typically uses 8 bits and compares the computed mean vector ($y_0$, $y_1$) against each candidate vectors from a codebook table such as that shown in Appendix D, "Mean Vector VQ Codebook (8-bit)". The comparison is based on a distance measure, e(i), which is typically calculated as:

$$e(i)=[x0(i)-y_0]^2+[x1(i)-y_1]^2 \text{ for } i=0, 1, \ldots, 255.$$

for the candidate codebook vector (x0(i), x1(i)). The 8 bit index, i, of the candidate vector that minimizes e(i) forms the output of the mean vector quantizer 608*b*. The output of the mean vector quantizer is then passed to combiner 609 to form part of the output of the magnitude quantizer. Another hybrid vector/scalar method which is applied to the mean vector quantizer is described in U.S. application Ser. No. 08/818,130, filed Mar. 14, 1997, and entitled "MULTI-SUBFRAME QUANTIZATION OF SPECTRAL PARAMETERS", which is incorporated herein by reference.

Referring again to FIG. 6, the signals 603*a* and 603*b* are input to a block DCT quantizer 607 although other quantizer types can be employed as well. Two block DCT quantizer variations are commonly employed. In a first variation, the two subframe signals 603*a* and 603*b* are sequentially quantized (first subframe followed by last subframe), while in a second variation, signals 603*a* and 603*b* are quantized jointly. The advantage of the first variation is that prediction is more effective for the last subframe, since it can be based on the prior subframe (i.e. the first subframe) rather than on the last subframe in the prior frame. In addition the first variation is typically less complex and requires less coefficient storage than the second variation. The advantage of the second variation is that joint quantization tends to better exploit the redundancy between the two subframes lowering the quantization distortion and improving sound quality.

An example of a block DCT quantizer 607 is described in U.S. Pat. No. 5,226,084, which is incorporated herein by reference. In this example the signals 603*a* and 603*b* are sequentially quantized by computing a predicted signal based on the prior subframe, and then scaling and subtracting the predicted signal to create a difference signal. The difference signal for each subframe is then divided into a small number of blocks, typically 6 or 8 per subframe, and a Discrete Cosine Transforms (DCT) is computed for each block. For each subframe, the first DCT coefficient from each block is used to form a prediction residual block average (PRBA) vector, while the remaining DCT coefficients for each block form variable length HOC vectors. The PRBA vector and high order coefficient (HOC) vectors are then quantized using either vector or scalar quantization. The output bits form the output of the block DCT quantizer, 608*a*.

Another example of a block DCT quantizer 607 is disclosed in U.S. application Ser. No. 08/818,130, "MULTI-SUBFRAME QUANTIZATION OF SPECTRAL PARAMETERS". reference. In this example, the block DCT quantizer jointly quantizes the spectral parameters from both subframes. First, a predicted signal for each subframe is computed based on the last subframe from the prior frame. This predicted signal is scaled (0.65 or 0.8 are typical scale factors) and subtracted from both signals 603*a* and 603*b*. The resulting difference signals are then divided into blocks (4 per subframe) and each block is processed with a DCT. An 8 element PRBA vector is formed for each subframe by passing the first two DCT coefficients from each block through a further set of 2×2 transforms and an 8-point DCT. The remaining DCT coefficients from each block form a set of 4 HOC vectors per subframe. Next sum/difference computations are made between corresponding PRBA and HOC vectors from the two subframes in the current frame. The resulting sum/difference components are vector quantized and the combined output of the vector quantizers forms the output of the block DCT quantizer 608*a*.

In a further example, the joint subframe method disclosed in U.S. application Ser. No. 08/818,130 can be converted into a sequential subframe quantizer by computing a predicted signal for each subframe from the prior subframe, rather than from the last subframe in the prior frame, and by eliminating the sum/difference computations used to combine the PRBA and HOC vectors from the two subframes. The PRBA and HOC vectors are then vector quantized and the resulting bits for both subframes are combined to form the output of the spectral quantizer, 8*a*. This method allows use of the more effective prediction strategy combined with a more efficient block division and DCT computation. However it does not benefit from the added efficiency of joint quantization.

The output bits from the spectral quantizer 608*a* are combined in combiner 609 with the quantized gain bits 608*b* output from 606, and the result forms the output of the magnitude quantizer, 610, which also form the output of the magnitude quantizer 230 in FIG. 2.

Figure 7:
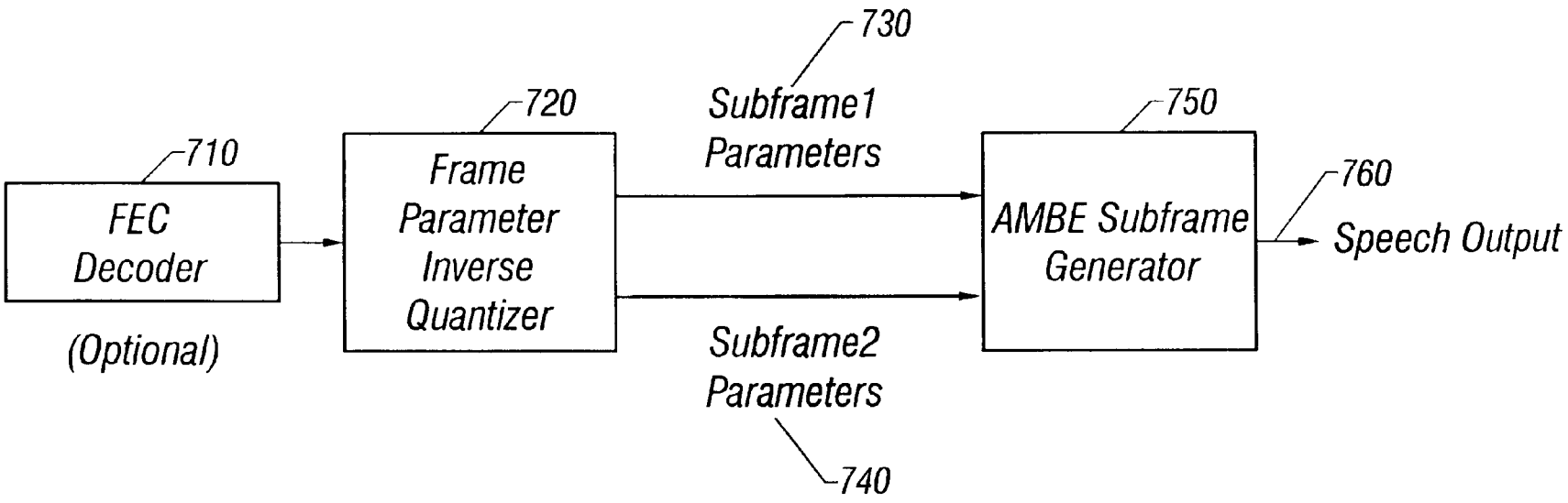
FIG. 7 is a block diagram of an AMBE® decoder system.

Implementations also may be described in the context of an AMBE® speech 20 decoder. As shown in FIG. 7, the digitized, encoded speech may be processed by a FEC decoder 710. A frame parameter inverse quantizer 720 then converts frame parameter data into subframe parameters 730 and 740 using essentially the reverse of the quantization process described above. The subframe parameters 730 and 740 are then passed to an AMBE® speech decoder 750 to be converted into speech output 760.

Figure 8:
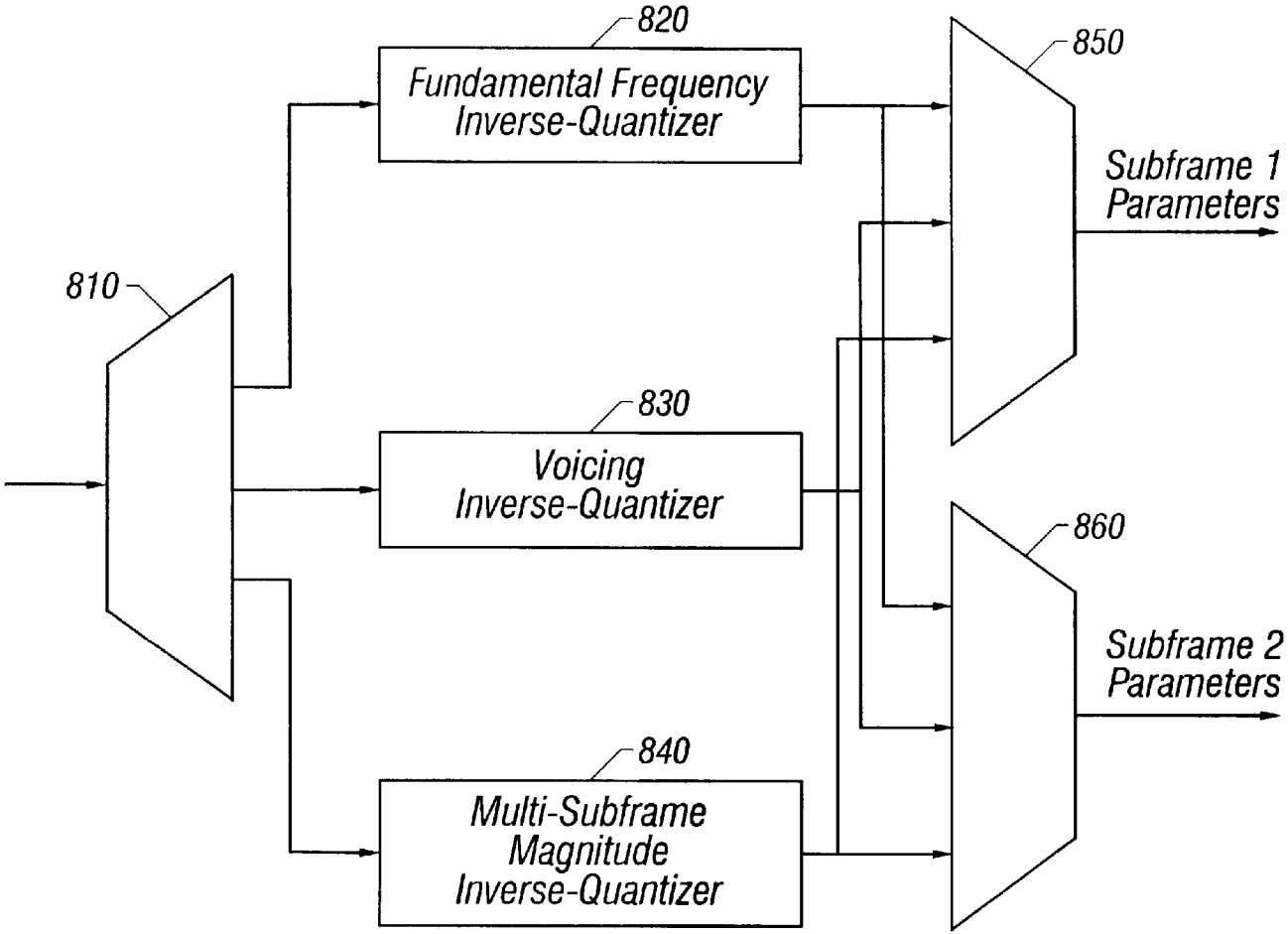
FIG. 8 is a block diagram of a joint parameter inverse quantizer.

A more detailed diagram of the frame parameter inverse quantizer is shown in FIG. 8. A divider 810 splits the incoming encoded speech signal to a fundamental frequency inverse quantizer 820, a voicing inverse quantizer 830, and a multi-subframe magnitude inverse quantizer 840. The inverse quantizers generate subframe parameters 850 and 860.

Figure 9:
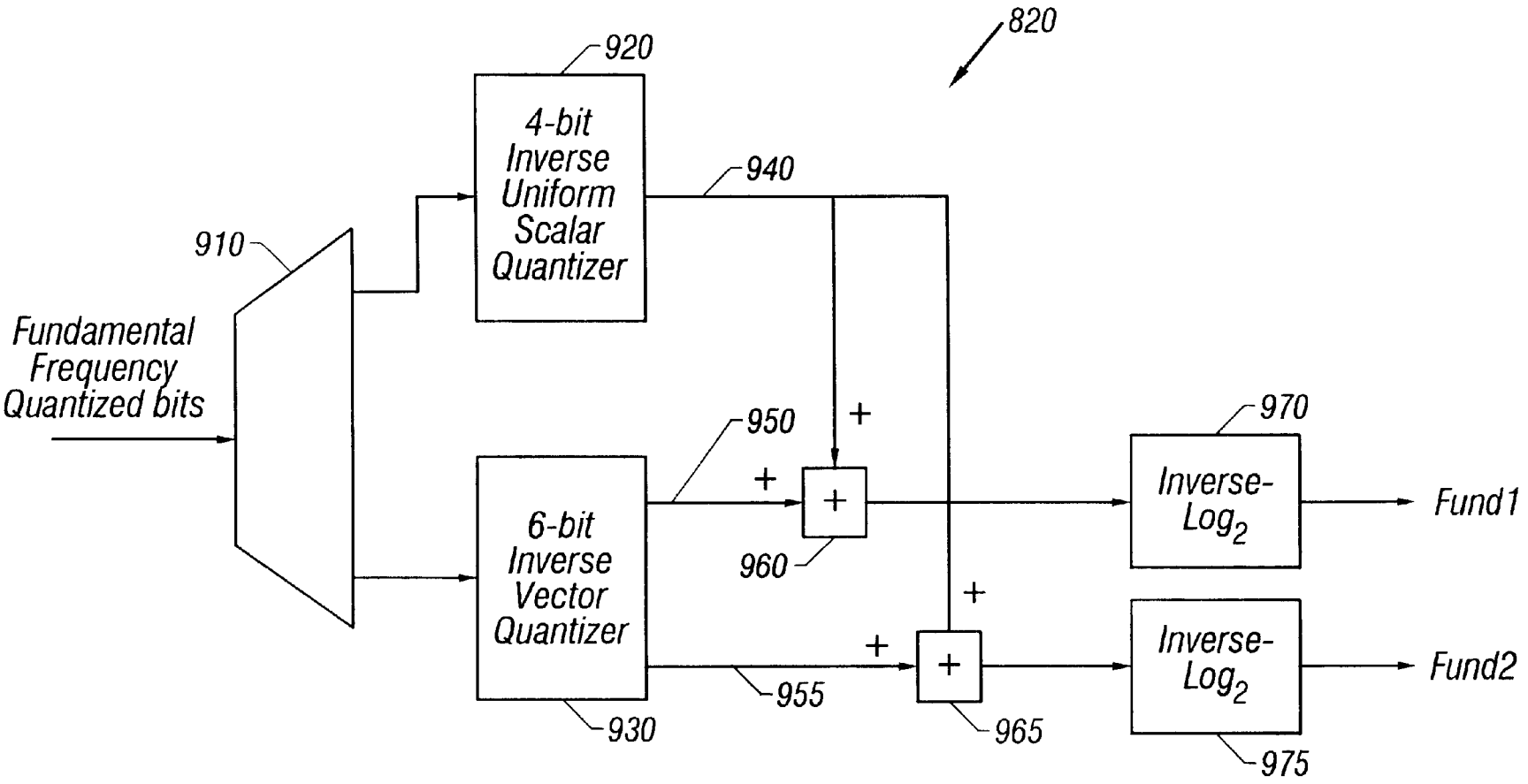
FIG. 9 is a block diagram of a fundamental frequency inverse quantizer.

FIG. 9 shows an example of a fundamental frequency inverse quantizer 820 that is complimentary to the quantizer described in FIG. 3. The fundamental frequency quantized bits are fed to a divider 910 which feeds the bits to a 4-bit inverse uniform scalar quantizer 920 and a 6-bit inverse vector quantizer 930. The output of the scalar quantizer 940 is combined using adders 960 and 965 to the outputs of the inverse vector quantizer 950 and 955. The resulting signals then pass through inverse companders 970 and 975 to form subframe fundamental frequency parameters fund1 and fund2. Other inverse quantizing techniques may be used, such as those described in the references incorporated above or those complimentary to the quantizing techniques described above.

Other embodiments are within the scope of the following claims.

APPENDIX A

Fundamental Frequency VQ Codebook (6-bit)

| Index: i | x0(i) | x1(i) |
|---|---|---|
| 0 | −0.931306f | 0.890160f |
| 1 | −0.745322f | 0.805468f |
| 2 | −0.719791f | 0.620022f |
| 3 | −0.552568f | 0.609308f |
| 4 | −0.564979f | 0.463964f |
| 5 | −0.379907f | 0.499180f |
| 6 | −0.418627f | 0.420995f |
| 7 | −0.379328f | 0.274983f |
| 8 | −0.232941f | 0.333147f |
| 9 | −0.251133f | 0.205544f |
| 10 | −0.133789f | 0.240166f |
| 11 | −0.220673f | 0.100443f |
| 12 | −0.058181f | 0.166795f |
| 13 | −0.128969f | 0.092215f |
| 14 | −0.137101f | 0.003366f |
| 15 | −0.049872f | 0.089019f |
| 16 | 0.008382f | 0.121184f |
| 17 | −0.057968f | 0.032319f |
| 18 | −0.071518f | −0.010791f |
| 19 | 0.014554f | 0.066526f |
| 20 | 0.050413f | 0.100088f |
| 21 | −0.093348f | −0.047704f |
| 22 | −0.010600f | 0.034524f |
| 23 | −0.028698f | −0.009592f |
| 24 | −0.040318f | −0.041422f |
| 25 | 0.001483f | 0.000048f |
| 26 | 0.059369f | 0.057257f |
| 27 | −0.073879f | −0.076288f |
| 28 | 0.031378f | 0.027007f |
| 29 | 0.084645f | 0.080214f |
| 30 | 0.018122f | −0.014211f |
| 31 | −0.037845f | −0.079140f |
| 32 | −0.001139f | −0.049943f |
| 33 | 0.100536f | 0.045953f |
| 34 | 0.067588f | 0.011450f |
| 35 | −0.052770f | −0.110182f |
| 36 | 0.043558f | −0.025171f |
| 37 | 0.000291f | −0.086220f |
| 38 | 0.122003f | 0.012128f |
| 39 | 0.037905f | −0.077525f |
| 40 | −0.008847f | −0.129463f |
| 41 | 0.098062f | −0.038265f |
| 42 | 0.061667f | −0.132956f |
| 43 | 0.175035f | −0.041042f |
| 44 | 0.126137f | −0.117586f |
| 45 | 0.059846f | −0.208409f |
| 46 | 0.231645f | −0.114374f |
| 47 | 0.137092f | −0.212240f |

APPENDIX A-continued

Fundamental Frequency VQ Codebook (6-bit)

| Index: i | x0(i) | x1(i) |
|---|---|---|
| 48 | 0.227208f | −0.239303f |
| 49 | 0.297482f | −0.203651f |
| 5o | 0.371823f | −0.230527f |
| 51 | 0.250634f | −0.368516f |
| 52 | 0.366199f | −0.397512f |
| 53 | 0.446514f | −0.372601f |
| 54 | 0.432218f | −0.542868f |
| 55 | 0.542312f | −0.458618f |
| 56 | 0.542148f | −0.578764f |
| 57 | 0.701488f | −0.585307f |
| 58 | 0.596709f | −0.741080f |
| 59 | 0.714393f | −0.756866f |
| 60 | 0.838026f | −0.748256f |
| 61 | 0.836825f | −0.916531f |
| 62 | 0.987562f | −0.944143f |
| 63 | 1.075467f | −1.139368f |

APPENDIX B

16 Element Voicing Metric VQ Codebook (6-bit)

| Index: i | Candidate Vector: $x_j(i)$ (see Note 1) |
|---|---|
| 0 | 0x0000 |
| 1 | 0x0080 |
| 2 | 0x00C0 |
| 3 | 0x00C1 |
| 4 | 0x00E0 |
| 5 | 0x00E1 |
| 6 | 0x00F0 |
| 7 | 0x00FC |
| 8 | 0x8000 |
| 9 | 0x8080 |
| 10 | 0x80C0 |
| 11 | 0x80C1 |
| 12 | 0x80E0 |
| 13 | 0x80F0 |
| 14 | 0x80FC |
| 15 | 0x00FF |
| 16 | 0xC000 |
| 17 | 0xC080 |
| 18 | 0xC0C0 |
| 19 | 0xC0C1 |
| 20 | 0xC0E0 |
| 21 | 0xC0F0 |
| 22 | 0xC0FC |
| 23 | 0x80FF |
| 24 | 0xC100 |
| 25 | 0xC180 |
| 26 | 0xC1C0 |
| 27 | 0xC1C1 |
| 28 | 0xC1E0 |
| 29 | 0xC1F0 |
| 30 | 0xC1FC |
| 31 | 0xC0FF |
| 32 | 0xE000 |
| 33 | 0xF000 |
| 34 | 0xE0C0 |
| 35 | 0xE0E0 |
| 36 | 0xF0FB |
| 37 | 0xF0F0 |
| 38 | 0xE0FF |
| 39 | 0xE1FF |
| 40 | 0xFC00 |
| 41 | 0xF8F8 |
| 42 | 0xFCFC |
| 43 | 0xFCFD |
| 44 | 0xFCFE |
| 45 | 0xF8FF |
| 46 | 0xFCFF |
| 47 | 0xF0FF |

APPENDIX B-continued

16 Element Voicing Metric VQ Codebook (6-bit)

| Index: i | Candidate Vector: $x_j(i)$ (see Note 1) |
|---|---|
| 48 | 0xFF00 |
| 49 | 0xFF80 |
| 50 | 0xFBFB |
| 51 | 0xFEE0 |
| 52 | 0xFEFC |
| 53 | 0xFEFE |
| 54 | 0xFDFF |
| 55 | 0xFEFF |
| 56 | 0xFFC0 |
| 57 | 0xFFE0 |
| 58 | 0xFFF0 |
| 59 | 0xFFF8 |
| 60 | 0xFFFC |
| 61 | 0xFFDF |
| 62 | 0xFFFE |
| 63 | 0xFFFF |

Note 1: Each codebook vector shown is represented as a 16 bit hexadecimal number where each bit represents a single element of a 16 element codebook vector and $x_j(i) = 1.0$ if the bit corresponding to $2^{15-j}$ is a 1 and $x_j(i) = 0.0$ if the same bit is a 0.

APPENDIX C

8 Element Voicing Metric Split VQ Codebook (4-bit)

| Index: i | Candidate Vector: $x_j(i)$ (see Note 2) |
|---|---|
| 0 | 0x00 |
| 1 | 0x80 |
| 2 | 0xC0 |
| 3 | 0xC1 |
| 4 | 0xE0 |
| 5 | 0xE1 |
| 6 | 0xF0 |
| 7 | 0xF1 |
| 8 | 0xF9 |
| 9 | 0xF8 |
| 10 | 0xFB |
| 11 | 0xDF |
| 12 | 0xFC |
| 13 | 0xFE |
| 14 | 0xFD |
| 15 | 0xFF |

Note 2: Each codebook vector shown is represented as a 8 bit hexadecimal number where each bit represents a single element of an 8 element codebook vector and $x_j(i) = 1.0$ if the bit corresponding to $2^{7-j}$ is a 1 and $x_j(i) = 0.0$ if the same bit is a 0.

APPENDIX D

UZ,10/23 Mean VQ Codebook (8-bit)

| Index: i | x0(i) | x1(i) |
|---|---|---|
| 0 | 0.000000 | 0.000000 |
| 1 | 0.670000 | 0.670000 |
| 2 | 1.330000 | 1.330000 |
| 3 | 2.000000 | 2.000000 |
| 4 | 2.450000 | 2.450000 |
| 5 | 2.931455 | 2.158850 |
| 6 | 3.352788 | 2.674527 |
| 7 | 3.560396 | 2.254896 |
| 8 | 2.900000 | 2.900000 |
| 9 | 3.300000 | 3.300000 |
| 10 | 3.700000 | 3.700000 |
| 11 | 4.099277 | 3.346605 |
| 12 | 2.790004 | 3.259838 |
| 13 | 3.513977 | 4.219486 |
| 14 | 3.598542 | 4.997379 |

APPENDIX D-continued

UZ,10/23 Mean VQ Codebook (8-bit)

| Index: i | x0(i) | x1(i) |
|---|---|---|
| 15 | 4.079498 | 4.202549 |
| 16 | 4.383822 | 4.261507 |
| 17 | 4.405632 | 4.523498 |
| 18 | 4.740285 | 4.561439 |
| 19 | 4.865142 | 4.949601 |
| 20 | 4.210202 | 4.869824 |
| 21 | 3.991992 | 5.364728 |
| 22 | 4.446965 | 5.190078 |
| 23 | 4.340458 | 5.734907 |
| 24 | 4.277191 | 3.843028 |
| 25 | 4.746641 | 4.017599 |
| 26 | 4.914049 | 3.746358 |
| 27 | 5.100000 | 4.380000 |
| 28 | 4.779326 | 5.431142 |
| 29 | 4.740913 | 5.856801 |
| 30 | 5.141100 | 5.772707 |
| 31 | 5.359046 | 6.129699 |
| 32 | 0.600000 | 1.600000 |
| 33 | 0.967719 | 2.812357 |
| 34 | 0.892968 | 4.822487 |
| 35 | 1.836667 | 3.518351 |
| 36 | 2.611739 | 5.575278 |
| 37 | 3.154963 | 5.053382 |
| 38 | 3.336260 | 5.635377 |
| 39 | 2.965491 | 4.516453 |
| 40 | 1.933798 | 4.198728 |
| 41 | 1.770317 | 5.625937 |
| 42 | 2.396034 | 5.189712 |
| 43 | 2.436785 | 6.188185 |
| 44 | 4.039717 | 6.235333 |
| 45 | 4.426280 | 6.628877 |
| 46 | 4.952096 | 6.373530 |
| 47 | 4.570683 | 6.979561 |
| 48 | 3.359282 | 6.542031 |
| 49 | 3.051259 | 7.506326 |
| 50 | 2.380424 | 7.152366 |
| 51 | 2.684000 | 8.391696 |
| 52 | 0.539062 | 7.097951 |
| 53 | 1.457864 | 6.531253 |
| 54 | 1.965508 | 7.806887 |
| 55 | 1.943296 | 8.680537 |
| 56 | 3.682375 | 7.021467 |
| 57 | 3.698104 | 8.274860 |
| 58 | 3.905639 | 7.458287 |
| 59 | 4.666911 | 7.758431 |
| 60 | 5.782118 | 8.000628 |
| 61 | 4.985612 | 8.212069 |
| 62 | 6.106725 | 8.455812 |
| 63 | 5.179599 | 8.801791 |
| 64 | 2.537935 | 0.507210 |
| 65 | 3.237541 | 1.620417 |
| 66 | 4.280678 | 2.104116 |
| 67 | 4.214901 | 2.847401 |
| 68 | 4.686402 | 2.988842 |
| 69 | 5.156742 | 2.405493 |
| 70 | 5.103106 | 3.123353 |
| 71 | 5.321827 | 3.049540 |
| 72 | 5.594382 | 2.904219 |
| 73 | 6.352095 | 2.691627 |
| 74 | 5.737121 | 1.802661 |
| 75 | 7.545257 | 1.330749 |
| 76 | 6.054249 | 3.539808 |
| 77 | 5.537815 | 3.621686 |
| 78 | 6.113873 | 3.976257 |
| 79 | 5.747736 | 4.405741 |
| 80 | 5.335795 | 4.074383 |
| 81 | 5.890949 | 4.620558 |
| 82 | 6.278101 | 4.549505 |
| 83 | 6.629354 | 4.735063 |
| 84 | 6.849867 | 3.525567 |
| 85 | 7.067692 | 4.463266 |
| 86 | 6.654244 | 5.795640 |
| 87 | 6.725644 | 5.115817 |
| 88 | 7.038027 | 6.594526 |
| 89 | 7.255906 | 5.963339 |
| 90 | 7.269750 | 6.576306 |

APPENDIX D-continued

UZ,10/23 Mean VQ Codebook (8-bit)

| Index: i | x0(i) | x1(i) |
|---|---|---|
| 91 | 7.476019 | 6.451699 |
| 92 | 6.614506 | 4.133252 |
| 93 | 7.351516 | 5.121248 |
| 94 | 7.467340 | 4.219842 |
| 95 | 7.971852 | 4.411588 |
| 96 | 5.306898 | 4.741349 |
| 97 | 5.552437 | 5.030334 |
| 98 | 5.769660 | 5.345607 |
| 99 | 5.851915 | 5.065218 |
| 100 | 5.229166 | 5.050499 |
| 101 | 5.293936 | 5.434367 |
| 102 | 5.538660 | 5.457234 |
| 103 | 5.580845 | 5.712945 |
| 104 | 5.600673 | 6.041782 |
| 105 | 5.876314 | 6.025193 |
| 106 | 5.937595 | 5.789735 |
| 107 | 6.003962 | 6.353078 |
| 108 | 5.767625 | 6.526158 |
| 109 | 5.561146 | 6.652511 |
| 110 | 5.753581 | 7.032418 |
| 111 | 5.712812 | 7.355024 |
| 112 | 6.309072 | 5.171288 |
| 113 | 6.040138 | 5.365784 |
| 114 | 6.294394 | 5.569139 |
| 115 | 6.589928 | 5.442187 |
| 116 | 6.992898 | 5.514580 |
| 117 | 6.868923 | 5.737435 |
| 118 | 6.821817 | 6.088518 |
| 119 | 6.949370 | 6.372270 |
| 120 | 6.269614 | 5.939072 |
| 121 | 6.244772 | 6.227263 |
| 122 | 6.513859 | 6.262892 |
| 123 | 6.384703 | 6.529148 |
| 124 | 6.712020 | 6.340909 |
| 125 | 6.613006 | 6.549495 |
| 126 | 6.521459 | 6.797912 |
| 127 | 6.740000 | 6.870000 |
| 128 | 5.174186 | 6.650692 |
| 129 | 5.359087 | 7.226433 |
| 130 | 5.029756 | 7.375267 |
| 131 | 5.068958 | 7.645555 |
| 132 | 6.664355 | 7.488255 |
| 133 | 6.156630 | 7.830288 |
| 134 | 6.491631 | 7.741226 |
| 135 | 6.444824 | 8.113968 |
| 136 | 6.996666 | 7.616085 |
| 137 | 7.164185 | 7.869988 |
| 138 | 7.275400 | 8.192019 |
| 139 | 7.138092 | 8.429933 |
| 140 | 6.732659 | 8.089213 |
| 141 | 7.009627 | 8.182396 |
| 142 | 6.823608 | 8.455842 |
| 143 | 6.966962 | 8.753537 |
| 144 | 6.138112 | 9.552063 |
| 145 | 6.451705 | 8.740976 |
| 146 | 6.559005 | 8.487588 |
| 147 | 6.808954 | 9.035317 |
| 148 | 7.163193 | 9.439246 |
| 149 | 7.258399 | 8.959375 |
| 150 | 7.410952 | 8.615509 |
| 151 | 7.581041 | 8.893780 |
| 152 | 7.924124 | 9.001600 |
| 153 | 7.581780 | 9.132666 |
| 154 | 7.756984 | 9.350949 |
| 155 | 7.737160 | 9.690006 |
| 156 | 8.330579 | 9.005311 |
| 157 | 8.179744 | 9.385159 |
| 158 | 8.143135 | 9.989049 |
| 159 | 8.767570 | 10.103854 |
| 160 | 6.847802 | 6.602385 |
| 161 | 6.980600 | 6.999199 |
| 162 | 6.811329 | 7.195358 |
| 163 | 6.977814 | 7.317482 |
| 164 | 6.104140 | 6.794939 |
| 165 | 6.288142 | 7.050526 |
| 166 | 6.031693 | 7.287878 |

APPENDIX D-continued

UZ,10/23 Mean VQ Codebook (8-bit)

| Index: i | x0(i) | x1(i) |
|---|---|---|
| 167 | 6.491979 | 7.177769 |
| 168 | 7.051968 | 6.795682 |
| 169 | 7.098476 | 7.133952 |
| 170 | 7.194092 | 7.370212 |
| 171 | 7.237445 | 7.052707 |
| 172 | 7.314365 | 6.845206 |
| 173 | 7.467919 | 7.025004 |
| 174 | 7.367196 | 7.224185 |
| 175 | 7.430566 | 7.413099 |
| 176 | 7.547060 | 5.704260 |
| 177 | 7.400016 | 6.199662 |
| 178 | 7.676783 | 6.399700 |
| 179 | 7.815484 | 6.145552 |
| 180 | 7.657236 | 8.049694 |
| 181 | 7.649651 | 8.398616 |
| 182 | 7.907034 | 8.101250 |
| 183 | 7.950078 | 8.699924 |
| 184 | 7.322162 | 7.589724 |
| 185 | 7.601312 | 7.551097 |
| 186 | 7.773539 | 7.593562 |
| 187 | 7.592455 | 7.778636 |
| 188 | 7.560421 | 6.688634 |
| 189 | 7.641776 | 6.601144 |
| 190 | 7.622056 | 7.170399 |
| 191 | 7.665724 | 6.875534 |
| 192 | 7.713384 | 7.355123 |
| 193 | 7.854721 | 7.103254 |
| 194 | 7.917645 | 7.554693 |
| 195 | 8.010810 | 7.279083 |
| 196 | 7.970075 | 6.700990 |
| 197 | 8.097449 | 6.915661 |
| 198 | 8.168011 | 6.452487 |
| 199 | 8.275146 | 7.173254 |
| 200 | 7.887718 | 7.800276 |
| 201 | 8.057792 | 7.901961 |
| 202 | 8.245220 | 7.822989 |
| 203 | 8.138804 | 8.135941 |
| 204 | 8.240122 | 7.467043 |
| 205 | 8.119405 | 7.653336 |
| 206 | 8.367228 | 7.695822 |
| 207 | 8.513009 | 7.966637 |
| 208 | 8.322172 | 8.330768 |
| 209 | 8.333026 | 8.597654 |
| 210 | 8.350732 | 8.020839 |
| 211 | 8.088060 | 8.432937 |
| 212 | 8.954883 | 4.983191 |
| 213 | 8.323409 | 5.100507 |
| 214 | 8.343467 | 5.551774 |
| 215 | 8.669058 | 6.350480 |
| 216 | 8.411164 | 6.527067 |
| 217 | 8.442809 | 6.875090 |
| 218 | 9.224463 | 6.541130 |
| 219 | 8.852065 | 6.812091 |
| 220 | 8.540101 | 8.197437 |
| 221 | 8.519880 | 8.447232 |
| 222 | 8.723289 | 8.357917 |
| 223 | 8.717447 | 8.596851 |
| 224 | 8.416543 | 7.049304 |
| 225 | 8.792326 | 7.115989 |
| 226 | 8.783804 | 7.393443 |
| 227 | 8.801834 | 7.605139 |
| 228 | 8.821033 | 8.829527 |
| 229 | 9.052151 | 8.920332 |
| 230 | 8.939108 | 8.624935 |
| 231 | 9.205172 | 9.092702 |
| 232 | 8.547755 | 8.771155 |
| 233 | 8.835544 | 9.090397 |
| 234 | 8.810137 | 9.409163 |
| 235 | 8.977925 | 9.687199 |
| 236 | 8.650000 | 7.820000 |
| 237 | 9.094046 | 7.807884 |
| 238 | 9.444254 | 7.526457 |
| 239 | 9.250750 | 8.150009 |
| 240 | 8.950027 | 8.160572 |
| 241 | 9.110929 | 8.406396 |
| 242 | 9.631347 | 7.984714 |

APPENDIX D-continued

| UZ,10/23 Mean VQ Codebook (8-bit) | | |
|---|---|---|
| Index: i | x0(i) | x1(i) |
| 243 | 9.565814 | 8.353002 |
| 244 | 9.279979 | 8.751512 |
| 245 | 9.530565 | 9.097466 |
| 246 | 9.865425 | 8.720131 |
| 247 | 10.134324 | 9.530771 |
| 248 | 9.355123 | 9.429357 |
| 249 | 9.549061 | 9.863950 |
| 250 | 9.732582 | 9.483715 |
| 251 | 9.910789 | 9.786182 |
| 252 | 9.772920 | 10.193624 |
| 253 | 10.203835 | 10.070157 |
| 254 | 10.216146 | 10.372166 |
| 255 | 10.665868 | 10.589625 |

What is claimed is:

1. A method of encoding speech into a frame of bits, the method comprising:

digitizing a speech signal into a sequence of digital speech samples;

dividing the digital speech samples into a sequence of subframes, each of the subframes including multiple digital speech samples;

estimating a fundamental frequency parameter for each subframe;

designating subframes from the sequence of subframes as corresponding to a frame;

jointly quantizing fundamental frequency parameters from subframes of the frame to produce a set of encoder fundamental frequency bits; and including the encoder fundamental frequency bits in a frame of bits, wherein the joint quantization comprises:

computing fundamental frequency residual parameters as a difference between a transformed average of the fundamental frequency parameters and each fundamental frequency parameter;

combining the residual fundamental frequency parameters from the subframes of the frame; and quantizing the combined residual parameters.

2. The method of claim 1, wherein combining the residual parameters from the subframes of the frame includes performing a linear transformation on the residual parameters to produce a set of transformed residual coefficients for each subframe.

3. The method of claim 1, wherein fundamental frequency parameters represent log fundamental frequency estimated for a Multi-Band Excitation (MBE) speech module.

4. The method of claim 1, further comprising producing additional encoder bits by quanitizing additional speech model parameters other than the fundamental frequency parameters and including the additional encoder bits in the frame of bits.

5. The method of claim 4, wherein the additional speech model parameters include parameters representative of spectral magnitudes.

6. A method of encoding speech into a frame of bits, the method comprising:

digitizing a speech signal into a sequence of digital speech samples;

estimating a set of voicing metrics parameters for a group of digital speech samples, the set including multiple voicing metrics parameters;

jointly quantizing the voicing metrics parameters to produce a set of encoder voicing metrics bits; and including the encoder voicing metrics bits in a frame of bits.

7. The method of claim 6, further comprising:

dividing the digital speech samples into a sequence of subframes, each of the subframes including multiple digital speech samples; and designating subframes from the sequence of subframes as corresponding to a frame;

wherein the group of digital speech samples corresponds to the subframes corresponding to the frame.

8. The method of claim 7, wherein jointly quantizing multiple voicing metrics parameters comprises jointly quantizing at least one voicing metrics parameter for each of multiple subframes.

9. The method of claim 7, wherein jointly quantizing multiple voicing metrics parameters comprises jointly quantizing multiple voicing metrics parameters for a single subframe.

10. The method of claim 6, wherein the joint quantization comprises:

computing voicing metrics residual parameters as the transformed ratios of voicing error vectors and voicing energy vectors;

combining the residual voicing metrics parameters; and quantizing the combined residual parameters.

11. The method of claim 10, wherein combining the residual parameters includes performing a linear transformation on the residual parameters to produce a set of transformed residual coefficients for each subframe.

12. The method of claim 10, wherein quantizing the combined residual parameters includes using at least one vector quantizer.

13. The method of claim 6, wherein the frame of bits includes redundant error control bits protecting at least some of the encoder voicing metrics bits.

14. The method of claim 6, wherein voicing metrics parameters represent voicing states estimated for a Multi-Band Excitation (MBE) speech model.

15. The method of claim 6, further comprising producing additional encoder bits by quantizing additional speech model parameters other than the voicing metrics parameters and including the additional encoder bits in the frame of bits.

16. The method of claim 15, wherein the additional speech model parameters include parameters representative of spectral magnitudes.

17. The method of claim 15, wherein the additional speech model parameters include parameters representative of a fundamental frequency.

18. The method of claim 17, wherein the additional speech model parameters include parameters representative of the spectral magnitudes.

19. A method of encoding speech into a frame of bits, the method comprising:

digitizing a speech signal into a sequence of digital speech samples;

dividing the digital speech samples into a sequence of subframes, each of the subframes including multiple digital speech samples;

estimating a fundamental frequency parameter for each subframe;

designating subframes from the sequence of subframes as corresponding to a frame;

quantizing a fundamental frequency parameter from one subframe of the frame;

interpolating a fundamental frequency parameter for another subframe of the frame using the quantized fundamental frequency parameter from the one subframe of the frame;

combining the quantized fundamental frequency parameter and the interpolated fundamental frequency parameter to produce a set of encoder fundamental frequency bits; and including the encoder fundamental frequency bits in a frame of bits.

20. A speech encoder for encoding speech into a frame of bits, the encoder comprising:

means for digitizing a speech signal into a sequence of digital speech samples;

means for estimating a set of voicing metrics parameters for a group of digital speech samples, the set including multiple voicing metrics parameters;

means for jointly quantizing the voicing metrics parameters to produce a set of encoder voicing metrics bits; and means for forming a frame of bits including the encoder voicing metrics bits.

21. The speech encoder of claim 20, further comprising:

means for dividing the digital speech samples into a sequence of subframes, each of the subframes including multiple digital speech samples; and means for designating subframes from the sequence of subframes as corresponding to a frame;

wherein the group of digital speech samples corresponds to the subframes corresponding to the frame.

22. The speech encoder of claim 21, wherein the means for jointly quantizing multiple voicing metrics parameters jointly quantizes at least one voicing metrics parameter for each of multiple subframes.

23. The speech encoder of claim 21, wherein the means for jointly quantizing multiple voicing metrics parameters jointly quantizes multiple voicing metrics parameters for a single subframe.

24. A method of decoding speech from a frame of bits that has been encoded by digitizing a speech signal into a sequence of digital speech samples, estimating a set of voicing metrics parameters for a group of digital speech samples, the set including multiple voicing metrics parameters, jointly quantizing the voicing metrics parameters to produce a set of encoder voicing metrics bits, and including the encoder voicing metrics bits in a frame of bits, the method of decoding speech comprising:

extracting decoder voicing metrics bits from the frame of bits;

jointly reconstructing voicing metrics parameters using the decoder voicing metrics bits; and synthesizing digital speech samples using speech model parameters which include some or all of the reconstructed voicing metrics parameters.

25. The method of decoding speech of claim 24, wherein the joint reconstruction comprises:

inverse quantizing the decoder voicing metrics bits to reconstruct a set of combined residual parameters for the frame;

computing separate residual parameters for each subframe from the combined residual parameters; and forming the voicing metrics parameters from the voicing metrics bits.

26. The method of claim 25, wherein the computing of the separate residual parameters for each subframe comprises:

separating the voicing metrics residual parameters for the frame from the combined residual parameters for the frame; and performing an inverse transformation on the voicing metrics residual parameters for the frame to produce the separate residual parameters for each subframe of the frame.

27. A decoder for decoding speech from a frame of bits that has been encoded by digitizing a speech signal into a sequence of digital speech samples, estimating a set of voicing metrics parameters for a group of digital speech samples, the set including multiple voicing metrics parameters, jointly quantizing the voicing metrics parameters to produce a set of encoder voicing metrics bits, and including the encoder voicing metrics bits in a frame of bits, the decoder comprising:

means for extracting decoder voicing metrics bits from the frame of bits;

means for jointly reconstructing voicing metrics parameters using the decoder voicing metrics bits; and means for synthesizing digital speech samples using speech model parameters which include some or all of the reconstructed voicing metrics parameters.

28. Software on a processor readable medium comprising instructions for causing a processor to perform the following operations:

estimate a set of voicing metrics parameters for a group of digital speech samples, the set including multiple voicing metrics parameters;

jointly quantize the voicing metrics parameters to produce a set of encoder voicing metrics bits; and form a frame of bits including the encoder voicing metrics bits.

29. The software of claim 28, wherein the processor readable medium comprises a memory associated with a digital signal processing chip that includes the processor.

30. A communications system comprising:

a transmitter configured to:

digitize a speech signal into a sequence of digital speech samples;

estimate a set of voicing metrics parameters for a group of digital speech samples, the set including multiple voicing metrics parameters;

jointly quantize the voicing metrics parameters to produce a set of encoder voicing metrics bits;

form a frame of bits including the encoder voicing metrics bits; and transmit the frame of bits, and a receiver configured to receive and process the frame of bits to produce a speech signal.

* * * * *

UNITED STATES PATENT AND TRADEMARK OFFICE

CERTIFICATE OF CORRECTION

PATENT NO. : 6,199,037 B1
DATED : March 6, 2001
INVENTOR(S) : John C. Hardwick

It is certified that error appears in the above-identified patent and that said Letters Patent is hereby corrected as shown below:

Title page,
Item [56], References Cited,
U.S. PATENT DOCUMENTS, at "4,618,982", "Horvathe t al." should be -- Horvath et al. --.
OTHER PUBLICATIONS, the "Almeida et al." reference, "Am" should be -- An --.

Column 1,
Line 64, after "a", insert -- joint --.

Column 3,
Line 46, after "Analysis", insert -- , --.

Column 4,
Line 35, after "3,715,365;", delete "and".

Column 9,
Line 28, "vener,(0)" should be -- $vener_i(0)$ --.

Column 11,
Line 32, "$l_k$" should be -- $lv_k$ --.

Column 14,
Line 13, "HOC" should be -- higher order coefficient (HOC) --.
Line 14, "high order coefficient (HOC)" should be -- HOC --.
Line 20, delete "reference.".
Line 58, after "speech", delete "20".

Signed and Sealed this

Seventh Day of May, 2002

*Attest:*

*Attesting Officer*

JAMES E. ROGAN
*Director of the United States Patent and Trademark Office*